US008387178B2

(12) United States Patent
Rivera et al.

(10) Patent No.: US 8,387,178 B2
(45) Date of Patent: Mar. 5, 2013

(54) PLAYARD TOP RAIL AND LATCH MECHANISM

(75) Inventors: Matthew Rivera, Mableton, GA (US); Brandon Burkholder, Atlanta, GA (US); Michael A. Dotsey, Pottstown, PA (US); Johnny Hailyn Tseng, Atlanta, GA (US); Paul Nelson, Elverson, PA (US)

(73) Assignee: Graco Children's Products Inc., Atlanta, GA (US)

( * ) Notice: Subject to any disclaimer, the term of this patent is extended or adjusted under 35 U.S.C. 154(b) by 45 days.

(21) Appl. No.: 12/646,638

(22) Filed: Dec. 23, 2009

(65) Prior Publication Data

US 2010/0218311 A1 Sep. 2, 2010

Related U.S. Application Data

(60) Provisional application No. 61/156,411, filed on Feb. 27, 2009, provisional application No. 61/156,519, filed on Mar. 1, 2009.

(51) Int. Cl.
*A47D 7/00* (2006.01)

(52) U.S. Cl. ..... 5/99.1; 5/93.1; 5/93.2; 403/102

(58) Field of Classification Search ..... 5/99.1, 5/9.1, 83.1, 98.1, 94.1, 93.2, 9; 403/102
See application file for complete search history.

(56) References Cited

U.S. PATENT DOCUMENTS 4,499,619 A 2/1985 Kassai
5,211,498 A 5/1993 Huang
5,241,716 A 9/1993 Kohus
5,353,451 A 10/1994 Hsiung
5,474,404 A 12/1995 Chien
5,483,710 A 1/1996 Chan
5,485,655 A 1/1996 Wang
5,530,977 A 7/1996 Wang
5,542,151 A 8/1996 Stranski et al.
5,611,634 A 3/1997 Wang
5,617,592 A 4/1997 Cheng
5,730,542 A 3/1998 Cheng
5,745,954 A 5/1998 Shogan et al.
5,761,755 A 6/1998 Huang
5,781,944 A 7/1998 Huang
5,791,804 A 8/1998 Cheng
5,857,229 A 1/1999 Magnani, Jr.
5,964,545 A 10/1999 Cheng
5,978,987 A 11/1999 Wang
5,988,928 A 11/1999 Cheng
6,082,922 A 7/2000 Cheng
6,202,229 B1 3/2001 Cheng
6,223,366 B1 5/2001 Cheng (Continued)

OTHER PUBLICATIONS

European Search Report issued in corresponding European Application No. 10 15 2717, 3 sheets, mailed Jul. 15, 2010.

(Continued)

*Primary Examiner* — Robert G Santos
*Assistant Examiner* — Brittany Wilson
(74) *Attorney, Agent, or Firm* — Lempia Summerfield Katz LLC

(57) ABSTRACT

A juvenile product includes a frame with a rail, the rail including first and second rail sections, a latch assembly coupling the first and second rail sections and configured to reside in a latched state for an in-use orientation of the rail, and an elastic bias element coupled to the first rail section or the second rail section and configured to be under tension in or near the in-use orientation such that the elastic bias element drives the rail away from the in-use orientation when the rail is near the in-use orientation with the latch assembly not in the latched state.

20 Claims, 22 Drawing Sheets

U.S. PATENT DOCUMENTS

| | | | | |
|---|---|---|---|---|
| 6,250,837 | B1 | 6/2001 | Mariol et al. | |
| 6,363,550 | B1 | 4/2002 | Wang | |
| 6,634,039 | B1 | 10/2003 | Cheng | |
| 6,851,135 | B1 | 2/2005 | Chen | |
| 6,915,545 | B2 | 7/2005 | Chen | |
| 7,043,779 | B2 * | 5/2006 | Mendenhall et al. | 5/99.1 |
| 7,108,443 | B2 | 9/2006 | Chen | |
| 2005/0147463 | A1 | 7/2005 | Chen | |
| 2006/0225208 | A1 * | 10/2006 | Chen | 5/99.1 |
| 2007/0017025 | A1 * | 1/2007 | Myer | 5/99.1 |
| 2007/0079441 | A1 * | 4/2007 | Chen | 5/99.1 |
| 2007/0163041 | A1 * | 7/2007 | Cheng et al. | 5/99.1 |

OTHER PUBLICATIONS

Official Communication issued in corresponding European Application No. 10 152 717, 3 sheets, mailed Jun. 6, 2012.

* cited by examiner

PLAYARD TOP RAIL AND LATCH MECHANISM

CROSS-REFERENCES TO RELATED APPLICATIONS

This application claims the benefit of U.S. provisional application entitled "Playard Top Rail and Latch Mechanism," filed Feb. 27, 2009, and having Ser. No. 61/156,411, and the benefit of U.S. provisional application entitled "Playard Top Rail and Latch Mechanism," filed Mar. 1, 2009, and having Ser. No. 61/156,519, the entire disclosures of which are hereby expressly incorporated by reference.

BACKGROUND OF THE DISCLOSURE

1. Field of the Disclosure

The present disclosure is generally directed to juvenile products, and more particularly to top rail and latch constructions for playards.

2. Description of Related Art

Playards often have top rails with latching mechanisms. Each side and each end of a typical playard has a top rail. In many cases, each top rail has two rail sections pivotally connected to one another at the center of the top rail via a latching mechanism. The latching mechanism is configured to retain the top rail in a stiff, often linear condition for use. The latching mechanism is also configured to release the top rail to a loose condition for folding the playard. In the loose condition, each top rail can be folded, essentially in half, to allow compact folding of the playard.

Many playard designs have employed top rails that are generally straight or linear when in the stiff condition or in-use orientation. Some, more recent, playard designs have employed upwardly curved top rails at one or both ends of the playard. The curved rails provide a different aesthetic appearance to distinguish, for instance, a more upscale product platform.

A typical latching mechanism locks each top rail section independently and separately from one another. As a result, the top rail sections can pivot relative to the latching mechanism independent of one another. The top rail is then typically covered by fabric soft goods to hide or mask the underlying structures and components. When released, the latching mechanism usually moves downward, dropping the two rail sections at the center. When latched, the latching mechanism usually moves upward, raising the two rail sections until locking in the stiff condition.

Unfortunately, caregivers do not always receive visual confirmation that the top rail sections are fully latched because the top rails are covered with soft goods. One or both of the rail sections may fail at times to fully lock in place during set up or assembly. This condition is referred to herein as a false latch, or as "false latching."

False latch conditions remain rather visible with most existing playards with linear or straight top rails. The weight of the latching mechanism and soft goods tend to pull down the latching mechanism, leaving the top rail in a bent configuration. The state of the latch is often thus readily discernable to a caregiver.

On some designs with curved top rails, however, a false latching condition may not be readily visible or noticeable. With a curved top rail, the outer end pivot point of each top rail section is positioned at a lower elevation than the inner pivot points at the latching mechanism when latched. Thus, the curvature and geometry of the rail sections may tend to retain the latching mechanism in the elevated, nearly locked, i.e. false latched, condition without one or both of the rail sections being fully locked and latched. The tautness of the soft goods between the outer pivot points and below the latching mechanism, in conjunction with the pivot geometry, may also assist in creating and masking the false latching condition.

SUMMARY OF THE DISCLOSURE

In accordance with one aspect of the disclosure, a juvenile product includes a frame having a rail, the rail including first and second rail sections. The juvenile product further includes a latch assembly coupling the first and second rail sections and configured to reside in a latched state for an in-use orientation of the rail, and an elastic bias element coupled to the first rail section or the second rail section. The elastic bias element is configured to be under tension in or near the in-use orientation such that the elastic bias element drives the rail away from the in-use orientation when the rail is near the in-use orientation with the latch assembly not in the latched state.

In some cases, the elastic bias element is coupled to the first rail section and the second rail section. Alternatively or additionally, the elastic bias element is disposed between the latch assembly and the first rail section or the second rail section.

The elastic bias element may include a torsion spring. The juvenile product may further include a further torsion spring. Each torsion spring may then be disposed between the latch assembly and a respective one of the first and second rail sections. Alternatively or additionally, each torsion spring may have a fixed section attached to the latch assembly and a bias section that applies a bias force to a respective one of the first and second rail sections.

The latch assembly may include a pair of opposing pawls, each pawl having a latch seat configured to capture a respective one of the first and second rail sections in the in-use orientation. Alternatively, the latch assembly includes a pair of crosslinks, each crosslink coupling the first and second rail sections. The elastic bias element may then apply a bias force to the crosslinks in or near the in-use orientation. Each crosslink may include an elongate strip with a contoured edge that defines a channel in which a latch pin of the latch mechanism is captured in the latched state.

In accordance with another aspect of the disclosure, a juvenile product includes a frame having a rail, the rail including first and second rail sections. The juvenile product further includes a latch assembly configured to reside in a latched state for an in-use orientation of the rail, the latch assembly including a housing and a pair of latch crosslinks disposed within the housing. Each latch crosslink couples the first and second rail sections. The juvenile product still further includes a bias spring disposed within the housing, coupled to the first and second rail sections, and configured to be under tension near the in-use orientation such that the elastic bias element drives the rail away from the in-use orientation when the rail is near the in-use orientation with the latch assembly not in the latched state.

In some cases, the bias spring applies a bias force to the first and second latch crosslinks. The bias spring may include first and second torsion springs, each having a fixed section attached to the latch assembly and a bias section that applies a bias force to one of the first and second rail sections.

Each crosslink may include an elongate strip. Alternatively or additionally, the elongate strips may be oriented in parallel planes. The elongate strip may have a contoured edge that defines a channel in which a latch pin of the latch assembly is captured in the latched state.

In accordance with yet another aspect of the disclosure, a juvenile product includes a frame having a rail, the rail including first and second rail sections, a latch assembly coupling the first and second rail sections and configured to reside in a latched state for an in-use orientation of the rail, and first and second torsion springs coupled to the first and second rail sections, respectively. The first and second torsion springs are configured to be under tension in or near the in-use orientation such that the first and second torsion springs drive the rail away from the in-use orientation when the rail is near the in-use orientation with the latch assembly not in the latched state.

In some cases, the latch assembly includes a housing. Each of the first and second torsion springs may then include a pair of hooks attached to the housing. Alternatively or additionally, the housing may include a pair of spaced apart faceplates, each faceplate having a pair of ear tabs to guide windings of the first and second torsion springs and receive pivot pins about which the first and rail sections pivot. Alternatively or additionally, the latch assembly includes a pair of pawls disposed within the housing, each pawl including a latch seat configured to capture a respective one of the first and second rail sections in the in-use orientation. Alternatively or additionally, each of the first and second torsion springs includes a bail that engages and applies force to a respective one of the first and second rail sections. Alternatively or additionally, each of the first and second torsion springs may run along an exterior surface of each faceplate of the housing.

BRIEF DESCRIPTION OF THE DRAWINGS

Objects, features, and advantages of the present invention will become apparent upon reading the following description in conjunction with the drawing figures, in which like reference numerals identify like elements in the figures, and in which.

DETAILED DESCRIPTION OF THE DISCLOSURE

The disclosure is generally directed to playard top rails and latch assemblies that avoid or prevent false latch conditions. False latch prevention avoids unsafe use of the playard in which one or more rail sections are not fully locked and latched.

The disclosed playards, top rail constructions, and top rail latch assemblies may be useful in connection with a proposed revision to ASTM International standard F406 ("Standard Consumer Safety Specification for Non-Full-Size Baby Cribs/Play Yards"). The proposed revision may present a new requirement for playard top rails. The proposed revision states that, "No top rail shall give the appearance of being in the manufacturer's recommended use position unless the locking device is fully engaged. If the product has a latching device that automatically engages and is intended to be set up by first erecting the side rails, and then depressing a center floor hub, the product shall be evaluated for false latch by testing in accordance with section 8.X." Section 8.X would also describe the test method and the pass/fail requirements. There may be a myriad of solutions to the problem of false latching. For instance, some solutions may only provide an indication that a false latch has occurred. In contrast, the disclosed playards, top rail constructions, and top rail latch assemblies are directed to inhibiting or preventing a false latching condition.

The examples described below generally prevent or inhibit the top rail from assuming the appearance of being in the recommended use, or fully latched, position unless the lock is fully engaged. To that end, latch assemblies and playards are described herein with one or more elastic elements, including a variety of springs, that bias the top rail away from the fully latched position. The disclosed examples may be used with any top rail geometry (curved up, curved down, curved complexly, rounded, straight, etc.). In some cases, the disclosed latch assemblies also eliminate the need for independently latching each side or section of the top rail. To this end, several of the disclosed assemblies synchronize the latch mechanism to create a single latch point, thereby improving the usability of the playard. In other cases, the synchronization provided by the latch mechanism is directed to synchronized latch disengagement, or a single latch release for both rail sections. The latch mechanism allows the rail sections to move and latch independently of one another in such cases. With such independent latching, false latch conditions are avoided via separate elastic bias elements or springs dedicated to each rail section.

Although described in connection with playards and playard top rails, the disclosed latch assemblies may also be useful in connection with other portions of a playard frame assembly or other juvenile product assemblies.

Figure 1:
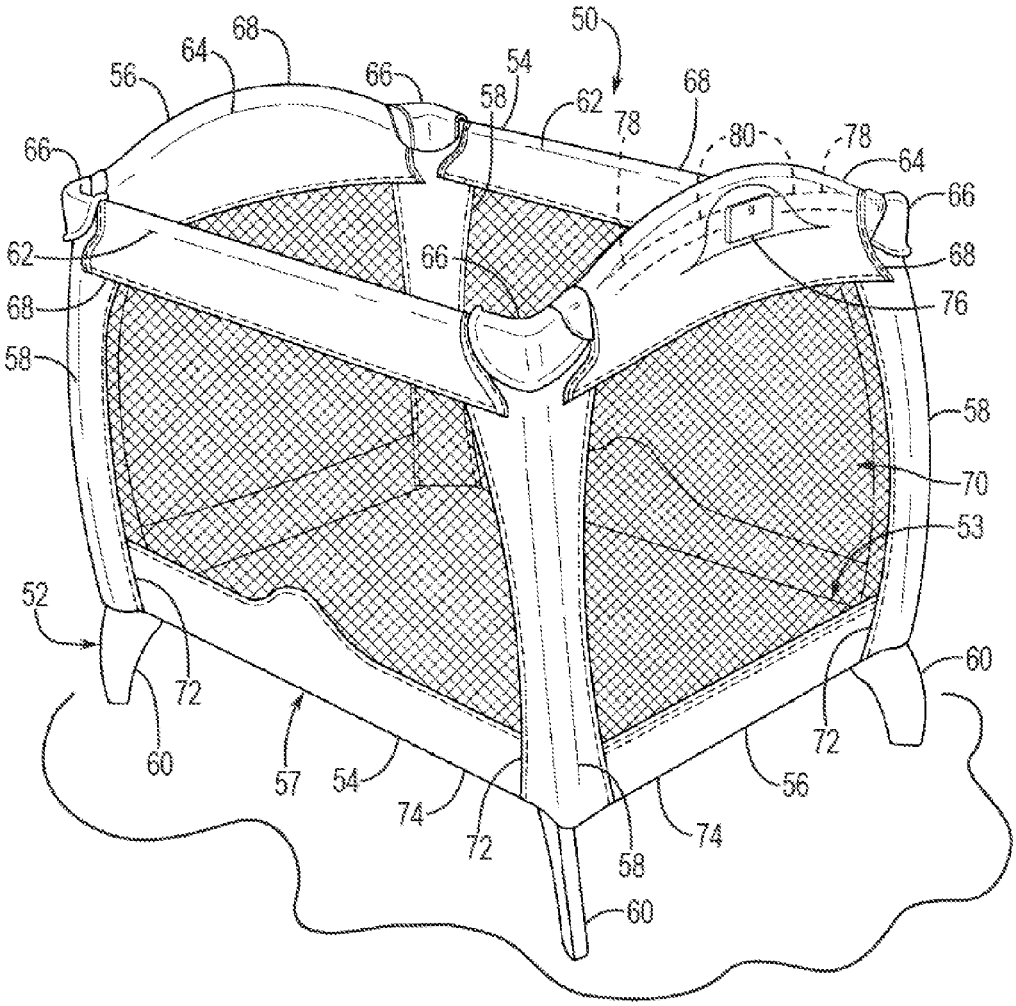
FIG. 1 is a perspective front view of an exemplary playard having top rails and latch assemblies constructed in accordance with several aspects of the disclosure.

Turning now to the drawing figures, FIG. 1 shows one example of a playard 50 configured in accordance with several aspects of the disclosure. The playard 50 has a frame assembly 52 that supports and defines a play or sleeping surface suspended above a floor or other ground surface. In this example, the frame assembly 52 defines a rectangular base 53, a pair of opposed main walls or panels 54, and a pair of opposed end walls or panels 56. The walls 54, 56 extend upward from the base 53 to surround the play surface and define a child containment area for an infant or toddler. The walls 54, 56 may be generally formed of a fabric and mesh material suspended from or supported by the frame assembly 52 as shown. Most of the frame assembly 52 is covered by fabric or other soft goods as described below. The frame assembly 52 is, thus, largely concealed as shown. Nonetheless, a number of components of the frame assembly 52 are shown in FIG. 1 by reference to the area of the soft goods covering the respective component.

The frame 52 includes a bottom or base frame structure 57 that defines and supports the base 53 above the floor surface. The frame 52 also includes four corner posts or legs 58 that extend upward from the base frame structure 57. The base frame structure 57 generally interconnects the corner posts 58 underneath the fabric or other soft goods that define the play surface of the playard 50 and conceal the base frame structure 57 as shown. The base frame structure 57 and the corner posts 58 are supported above, and spaced from, the floor by corresponding feet 60.

The frame 52 also includes a pair of top rails 62 disposed along the main walls 54 and a pair of top rails 64 along the end walls 56. Each top rail 62, 64 interconnects an adjacent pair of the posts 58, generally extending between the corner posts 58 to define an upper periphery of the playard 50. A turnbuckle or corner bracket 66 is positioned at the upper end of each corner post 58 and configured to pivotably connect the corner posts 58 to the top rails 62, 64.

The soft goods or fabric materials defining the walls 54, 56 include welting 68 that overlaps each top rail 62, 64 between the corner brackets 66. The welting 68 may be stitched or otherwise affixed to itself to capture fabric mesh 70 that forms each wall 54, 56. To that end, the welting 68 and the mesh 70 are suspended from the top rails 62, 64. The fabric mesh 70 is also sewn or otherwise affixed to corner edging 72 and base edging 74 that cover the corner posts 58 and perimeter of the base 53, respectively. With all edges of the fabric mesh 70 secured, the fabric mesh 70 and other soft goods of the playard 50 are generally stretched to a taut condition when the playard 50 is set for use as shown.

The playard 50 is foldable from the in-use or set-up orientation shown to a folded or storage configuration. To this end, the top rails 62, 64 pivot at each corner bracket 66, and the base frame structure 57 can fold inward bringing the corner posts 58 closer together and generally parallel to one another. As described below, each top rail 62, 64 is also foldable at a pivot latch assembly 76. The welting 68 is partially cutaway in FIG. 1 to reveal the pivot latch assembly 76 disposed under the welting 68 along one of the end walls 56. The pivot latch assembly 76 is centered between the corner posts 58 such that each top rail 62, 64 includes a pair of top rail sections 78. Each top rail section 78 may be tube-shaped, or include a bar or other rigid, elongated structure. The top rail sections 78 are pivotally coupled to a respective lateral side of the pivot latch assembly 76. In the set-up orientation, each top rail section 78 is secured by the pivot latch assembly 76 to generally extend laterally outward from the pivot latch assembly 76 toward the corner posts 58 as shown. Disengaging or unlatching the pivot latch assembly 76 allows the pivot latch assembly 76 and inner ends 80 of the top rail sections 78 to move downward as the playard 50 moves from the set-up orientation toward the folded orientation.

As shown in FIG. 1, the top rails 64 along the end walls 56 are bowed upward in this example to peak at the pivot latch assembly 76. Together, the top rail sections 78 and the pivot latch assembly 76 form an arch in the set-up orientation as shown. In contrast, the top rails 62 along the main walls 54 are not curved, generally running in a straight line between the corner posts 58. While the disclosed latch assemblies and top rail constructions are well suited for use with curved or bowed top rails like the top rails 64, each top rail 62, 64 may have a variety of shapes and designs, and need not be bowed or curved.

The shape, size, construction, and other characteristics of the above-described components of the frame assembly 52 may vary considerably from the example shown. For instance, the frame assembly 52 may have any number of sides or walls, any number of posts or feet, and a variety of different rail arrangements. Moreover, each component of the frame assembly 52, including the top rail sections 78, may be formed from a variety of materials, and need not be tubular in shape.

Figure 2:
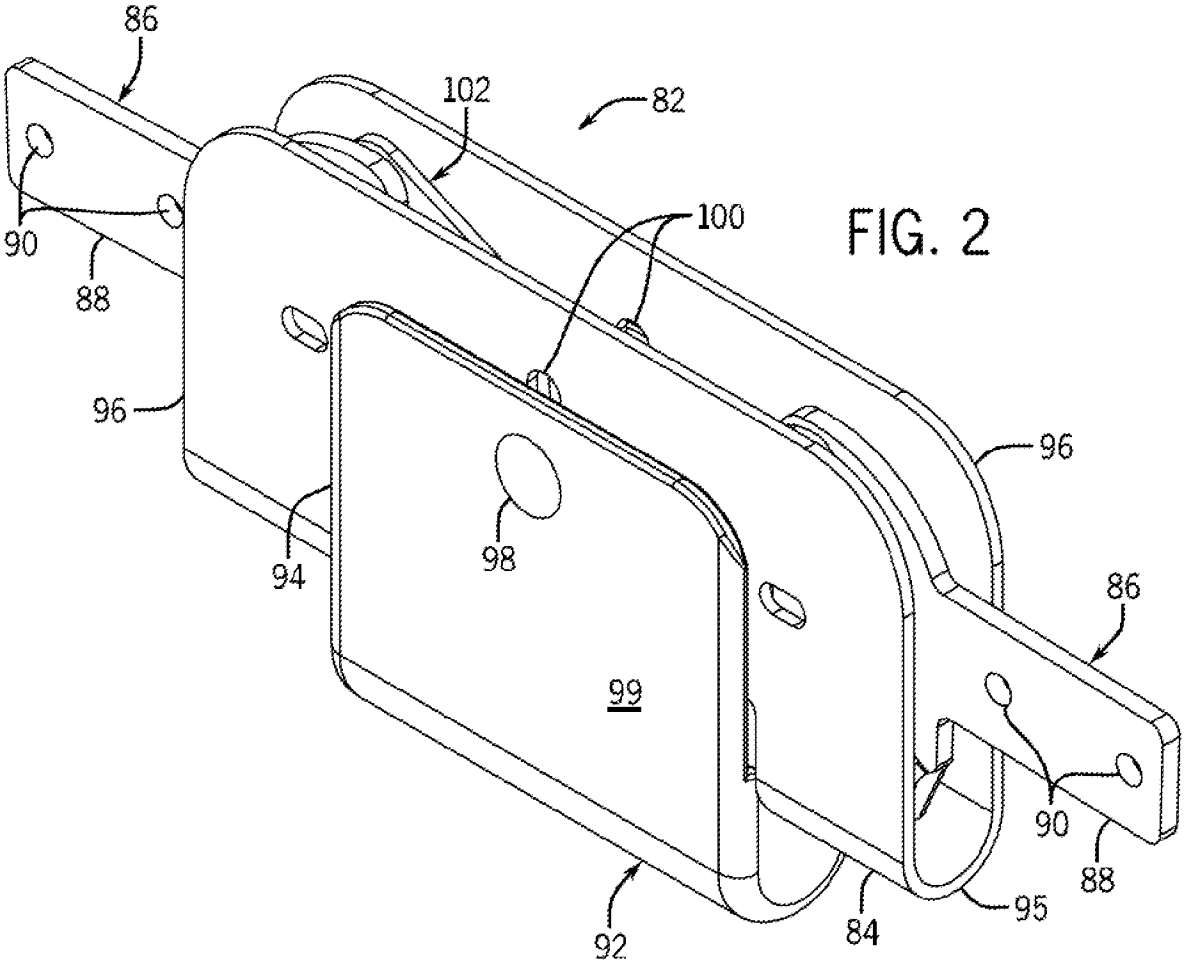
FIG. 2 is a perspective front view of an exemplary spring-biased latch assembly for one of the top rails of FIG. 1 in accordance with one embodiment.

FIG. 2 depicts one example of a top rail latch assembly 82 that may be incorporated into the playard 50 (FIG. 1) to prevent false latch conditions while also securing top rail connections. The latch assembly 82 includes a housing 84 and a pair of spaced apart rail connectors 86 laterally extending from the housing 84 in opposite directions. An inner portion of each rail connector 86 is generally enclosed within the housing 84, while outer ends of each rail connector 86 extend beyond open lateral ends of the housing 84 as shown. Each rail connector 86 is generally configured to attach to one of the top rail sections 78 (FIG. 1). To that end, each rail connector 86 may include a finger 88 having a number of holes 90 for attachment of bolts or other fasteners (not shown). The fingers 88 may, but need not, be shaped as a flattened bar or strip as shown, insofar as the nature of the engagement with the top rail sections 78 may vary considerably. In this example, each rail connector 86 and finger 88 thereof is formed from an integral strip or plate. As shown in FIG. 2, the finger 88 of each connector 86 generally extends in a horizontal direction, which generally corresponds with the set-up orientation of the playard and, thus, the latched state of the latch assembly 82. A pushbutton actuator 92 is slidably coupled to the housing 84 and configured to enable a user to release the assembly 82 from the latched state. In this example, the actuator 92 has a body 94 with a U-shaped cross-section that wraps around the housing 84 as a sleeve as shown.

The housing 84 in the example shown in FIG. 2 has a base 95 and a pair of opposing faceplates 96 (e.g., front and rear faceplates) spaced apart by the base 95. The housing 84 may be formed from a sheet or panel folded over roughly in half to define the base 95 and the faceplates 96. The faceplates 96 generally extend upward from the base 95 such that the housing 84 forms a shell or bracket with a U-shaped cross-section. The base 95 may, but need not, be rounded to provide for smooth transitions to the faceplates 96, which may be more comfortable for a user grasping the housing 84 to release the latch assembly 82 as described below. More generally, the shell formed by the base 95 and the faceplates 96 partially encloses and carries the functional components of the assembly 82. In this example, the housing shell has an open top and open lateral sides to allow the rail connectors 86 to be free to move as the playard 50 (FIG. 1) is folded and unfolded. The open-ended nature of the housing shell, the folded-over sheet construction, the shape and orientation of the base and faceplates, and other characteristics of the housing 84 may vary considerably from the example shown.

The actuator 92 protrudes below the base 95 of the housing 84 to present a pushbutton below the housing 84. The body 94 of the actuator 92 may also be constructed of sheet metal, but in this example is a molded plastic component. A pin, bolt, or other fastener 98 secures the actuator 92 to the housing 84 such that spaced apart, upstanding plates 99 of the body 94 are disposed alongside corresponding, respective exterior sides of the faceplates 96. The pin 98 travels in slots 100 formed in the faceplates 96 during operation. To disengage the latch assembly 82, an upward force applied by a user to the pushbutton actuator 92 drives the body 94 upward, causing the pin 98 to travel upward in the slots 100 and the plates 99 to slide in parallel alongside the exterior sides of the faceplates 96.

The latch assembly 82 of this example includes a dual, synchronized link latch 102 disposed between the faceplates 96 of the housing 84. The latch 102 is suspended within the slot or channel defined by the base 95 and the faceplates 96 of the housing 84. The link latch 102 interconnects the rail connectors 86 within the slot, synchronizing the movement of the connectors 86 during latch release and folding operations.

Figure 3:
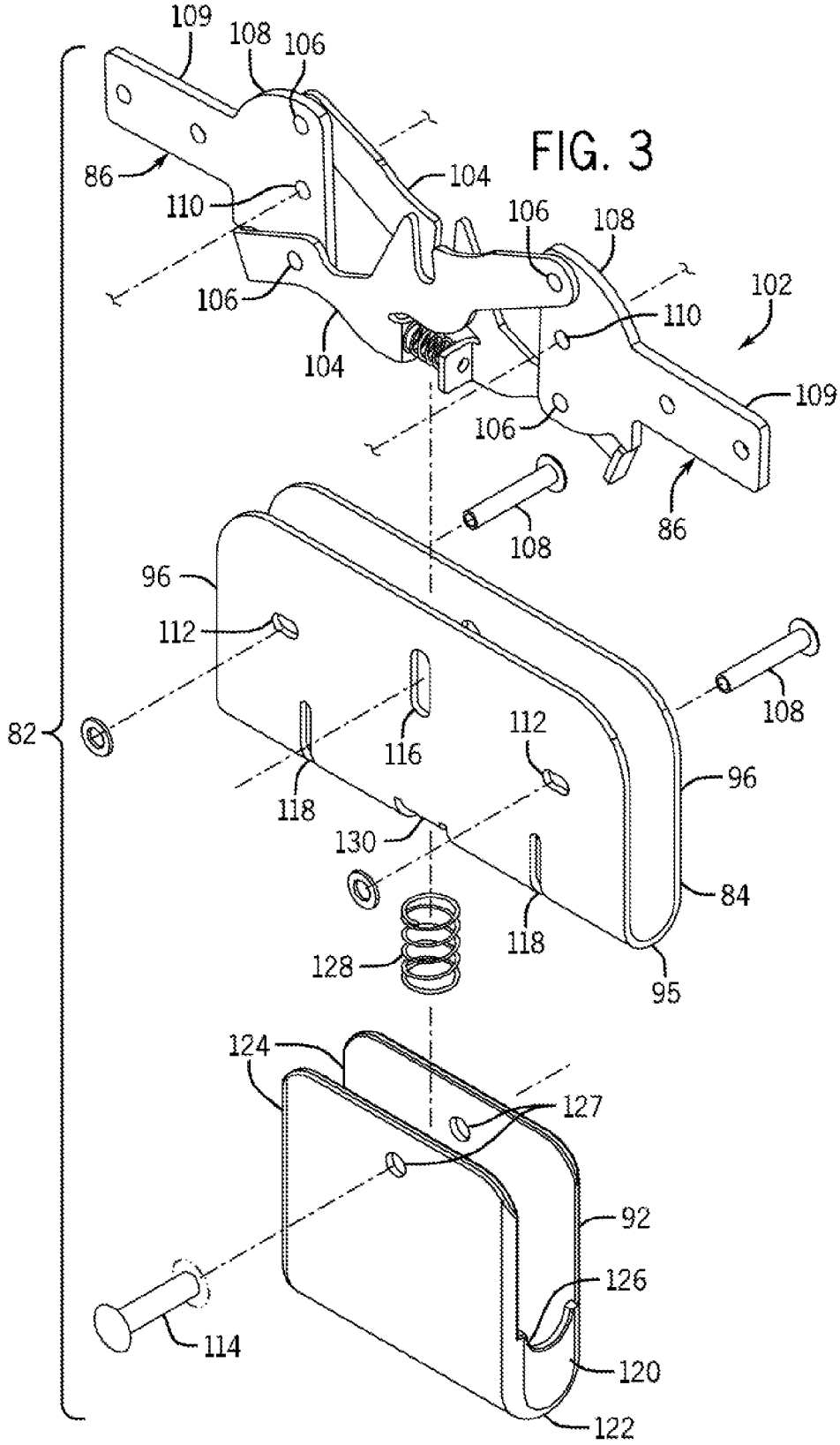
FIG. 3 is a partially exploded view of the latch assembly of FIG. 2 to depict a synchronized dual latch of the latch assembly of FIG. 2 biased to prevent false latch conditions in accordance with several aspects of the disclosure.

Turning now to FIG. 3, an exploded view of the top rail latch assembly 82 reveals the construction and configuration of the link latch 102. In this example, the link latch 102 includes a pair of spaced apart, elongate latch crosslinks 104. Each crosslink 104 generally extends the width of the faceplates 96 or, more generally, the housing 84, to link or couple the rail connectors 86 to one another. As shown in FIG. 3, the crosslinks 104 are oriented on intersecting inclines in the orientation shown in FIG. 3. As described below, the inclination and relative orientation of the crosslinks 104 change as the rail connectors 86 move as the playard is folded. The pair of crosslinks 104 are generally disposed within respective parallel, upright planes within the housing 84. The crosslinks 104 remain in the respective planes during operation (e.g., a release operation, a folding operation, etc.). One of the crosslinks 104 is positioned forward of the rail connectors 86, while the other crosslink 104 is positioned rearward of the rail connectors 86. With the crosslinks 104 disposed on opposite sides of the rail connectors 86, the parallel planes are spaced apart by the thickness of the rail connectors 86.

Each crosslink 104 terminates at two outer ends that overlap a respective rail connector 86. The overlap allows each end of the crosslink 104 to be coupled to the rail connectors 86 at a pair of pivot points 106 on an inner end or head 108 of the connector 86. The pivot points 106 of each pair are vertically spaced apart along the inner end 108, such that the points may be referenced as upper and lower pivot points during the latched state shown. The inner end or head 108 may be widened relative to the remainder of the rail connector 86 as shown to accommodate the spacing. To this end, each rail connector 86 may be T-shaped, with the inner end or head 108 positioned at the end of a finger 109 that extends laterally outward in the latched state. Pins, bolts, or other fasteners (not shown) may be used to pivotally couple the crosslinks 104 and the rail connectors 86 at the pivot points 106. Once coupled, the rail connectors 86 and the crosslinks 104 are suspended within the housing 84 via pivot pins or other fasteners 108 that pass through a central pivot point 110 in the inner end 108 of the rail connectors 86 and mounting holes 112 in the faceplates 96. The inner end 108 of each crosslink 86 rotates about the central pivot point 110 as the playard folds.

A latch pin 114 engages each crosslink 104 when the latch 102 is in the latched state. As described below, the latch pin 114 generally maintains the relative orientation of the crosslinks 104 in the latched state. The latch pin 114 also couples the actuator 92 to the housing 84 to allow the movement of the actuator 92 to affect the crosslinks 104. Each faceplate 96 has a slot 116 in which the latch pin 114 is captured as it passes through the interior cavity of the housing 84. Between the faceplates 96, the interaction of the latch pin 114 and the crosslinks 86 generally determines the state of the latch. As described below, the travel of the latch pin 114 within the slots 116 is restricted by the crosslinks 104 when the assembly is fully latched, thereby preventing an unintentional disengagement of the latch assembly 82. In this way, the latch pin 114 also prevents the latch assembly 82 from pivoting to a folded or released state.

FIG. 3 also depicts the housing 84 separated from the pushbutton actuator 92. Each faceplate 96 of the housing 84 includes a pair of grooves 118 in which side walls 120 of the actuator 92 slide when the actuator 92 is moved upward. The side walls 120 are positioned at lateral ends of the actuator 92, extending upward from a bottom or base 122 of the actuator 92 that integrally connects a pair of upstanding, opposing faceplates 124. The side walls 120 provide structural rigidity to the actuator 92 by extending as far upward as possible without interfering with the components disposed within the housing 84, such as the link latch 102 and the rail connectors 84. To that end, the side walls 120 may have a concave upper edge 126 as shown. The faceplates 124 of the actuator 92 are spaced apart by the side walls 120 and the base 122. Located near the top edge of each faceplate 124 is a hole 127 in which the latch pin 114 is captured. The latch pin 114 and the actuator 92 are biased to a low position by an actuator return spring 128 disposed between the actuator 92 and a base plate 130 formed in the base 95 of the housing 84. The bias spring 128 may rest on a mounting surface (not shown) formed between the faceplates 124 of the actuator 92 or on the top surface of the base 122. The spring mount for the actuator 92 may be configured in a variety of ways to guide and position the spring 128. For example, the mount may include a pair of upright, orthogonal ridges (not shown) engaged by the spring 128 to prevent the spring 128 from moving laterally.

Figure 4:
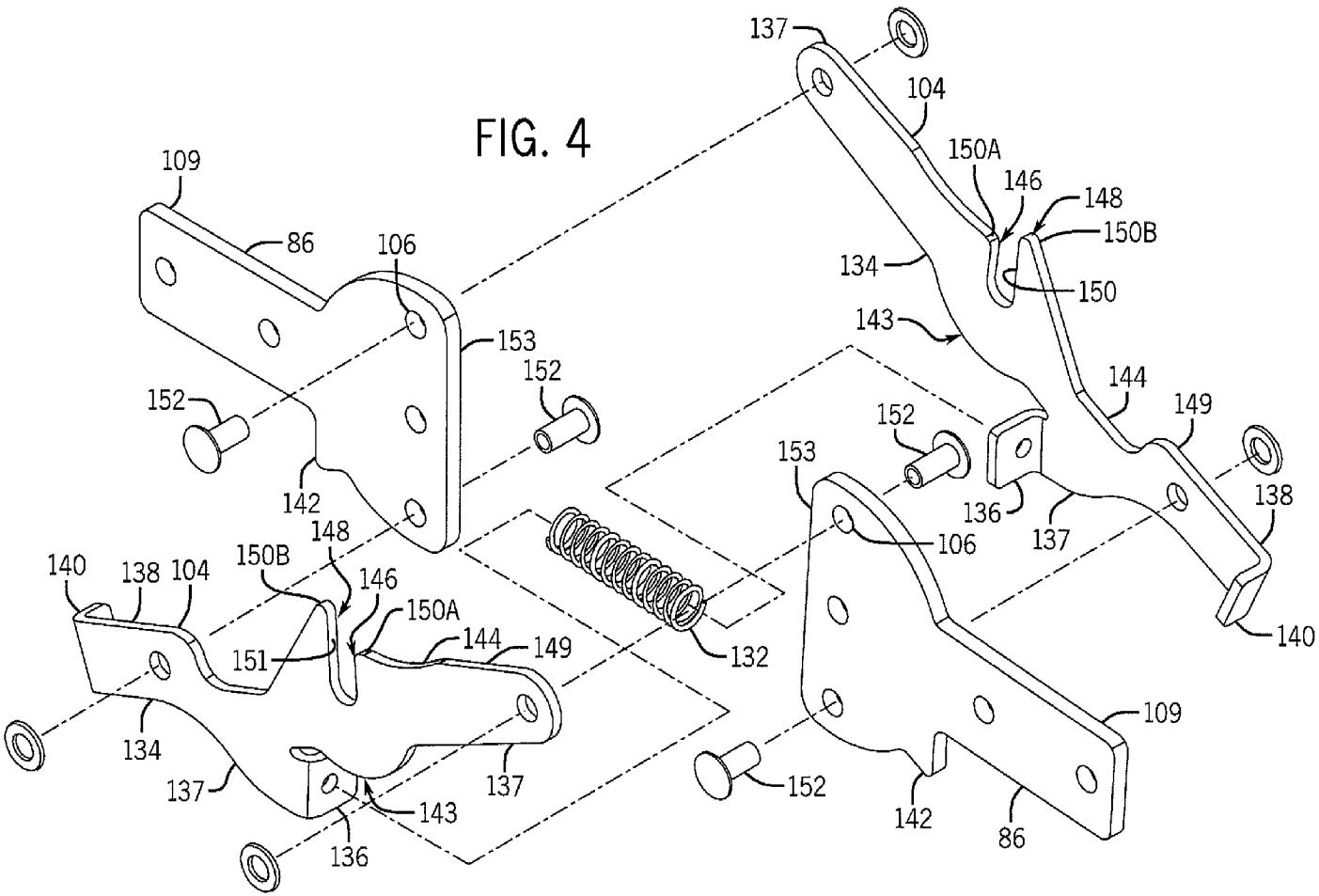
FIG. 4 is an exploded view of the synchronized dual latch of FIG. 3.

FIG. 4 shows the link latch 102 and the pivotal coupling of the crosslinks 104 and the rail connectors 86 in greater detail Like each rail connector 86, each crosslink 104 includes an elongated strip or plate 134 oriented on edge within the housing 84. Each strip 134 is generally oriented in an upright, vertical plane in parallel with the planes in which the other components of the latch 102 are disposed (e.g., the planes of the rail connectors 84, the faceplates 96, etc.). The respective planes of the strips 134 are spaced apart by the thickness of the rail connectors 86. A bias spring 132 is disposed within the housing 84 in tension between tabs 136 of the strips 134. Generally speaking, the crosslinks 104 are spring-loaded or biased away from the latched state or position by the bias spring 132. The tabs 136 extend inward from the plane of each respective strip 134 to provide a surface engaged by the bias spring 132. In this sheet-metal-based example, each tab 136 is formed by bending a fin-shaped extension 137 of each strip 134 that projects downward from a lower edge of each strip 134. The extension 137 is bent toward the interior of the latch assembly until the extension is orthogonal to the plane of the strip 134. In other cases, the tabs 136 may be part of a molded component shaped in a similar manner. As described below, the bias spring 132 is compressed by the tabs 136 of the strips 134 as the playard moves from the folded configuration to the in-use configuration. In this way, the bias spring 132 bears against the tabs 136 as the latch 102 nears the latched state. The interaction of the spring 132 and the strips 134 thus helps to prevent the top rail from entering a false latch condition by biasing the latch 102 away from the latched state.

Each strip 134 is cut or otherwise formed into an oblong shape. The strip 134 extends along a primary longitudinal direction from one longitudinal end section with an end connector 137 to an opposite longitudinal end section with an end connector 138. Each end connector 137, 138 is disposed at or near its respective longitudinal end. In this example, each end connector 137, 138 includes a hole formed in the respective end section of the strip 134. The strip 134 is oriented in the latched state with the end connectors 137, 138 pivotably coupled to the upper and lower pivot positions 106 of the head 108 of the rail connector 86, respectively.

In this example, the end link section 137 is shaped as a finger or extension of the strip 134 in the longitudinal direction. The end link section 138 is also shaped as a finger or extension of the strip 134 in the longitudinal direction, but also has a tab 140 inwardly bent to act as a stop to prevent the rail connectors 86 from rotating in the wrong direction from the latched state. To this end, each rail connector 86 has a projection 142 that extends downward from each rail connector 86 to meet a respective one of the tabs 140 when the link latch 102 is in the latched state. An attempt to move the top rail sections 78 (FIG. 1) in a manner that raises the latch assembly 76 (FIG. 1) causes the finger 109 of the rail connectors to try and move downward. Such movement is blocked by the impact of the tabs 140 and the projections 142.

The crosslinks 104 are pivotally coupled to the rail connectors 86 in an arrangement that may be considered a four-bar linkage. The strip 134 of each crosslink 104 extends between the rail connectors 86 at an angle with respect to the horizontal to allow the rail connectors 86 to pivot upward for playard folding. The strips 134 are inclined to accommodate the pivotal connections to the pivot points 106 on each rail connector 106. The crosslinks 104 engage opposing sides of the rail connectors 86 to avoid interfering with one another during the pivoting movement. Pivot pins or bolts 152 pivotally connect inner ends 153 of the rail connectors 86 to the end link sections 137, 138 of the strips 134. As a result, two of the four bars of the four-bar linkage are provided by the inner ends 153 of the rail connectors 86, while the other two bars of the four-bar linkage are provided by the crosslinks 104.

The linkage arrangement interconnects the rail connectors 86 and, thus, the top rail sections 78 (FIG. 1) to which the rail connectors 86 are secured. As a result, the top rail sections 78 move, latch, and release in unison instead of independently. As a result, this exemplary embodiment provides the added benefit of a single or synchronous latch. The simplified nature of the single or synchronous latch improves the usability of the playard, insofar as the user no longer has to independently latch each rail section to lock the top rail in the set-up position. Synchronization of the rail sections also forces an either locked or unlocked condition of the entire construction, which may result in a more stable product during setup and take down of the product.

Each strip 134 includes a central latch section 143 between the end connectors 137, 138. The central latch section 143 has an exterior surface 144 contoured to present and define a latch catch or clasp 146 and a reverse obstruction or stop 148 of each crosslink 104. In this example, the exterior surface 144 is an upper edge 149 of the strip 134. The latch catch 146 and the reverse stop 148 are defined by projections or peaks 150A, 150B disposed along the upper edge 144. The projections 150A, 150B are spaced from one another in the longitudinal direction such that the upper edge 144 is contoured or otherwise shaped to define a channel 151 that, in turn, defines the latch catch 146 and the reverse stop 148. The channel 151 extends downward from and between the projections 150A, 150B, spacing the projections from one another along the edge 149. As described below, the assembly of the crosslinks 104 aligns the channels 151 of the strips 134 in a manner that determines the state of the latch assembly 76 (FIG. 1). More specifically, the latch assembly 76 resides in the latched state when the channels 151 are not aligned with the slot 116 (FIG. 3), in which case each latch catch 146 restricts the width of the slot 116 and prevents movement of the latch pin 114 within the slot 116. The latch assembly 76 can be disengaged when the channels 151 are aligned with the slot 116, in which case each latch catch 146 is no longer disposed in or otherwise blocking the slot 116.

FIGS. 5-9 depict the different states or positions of the synchronized link latch 102 during operation.

Figure 5:
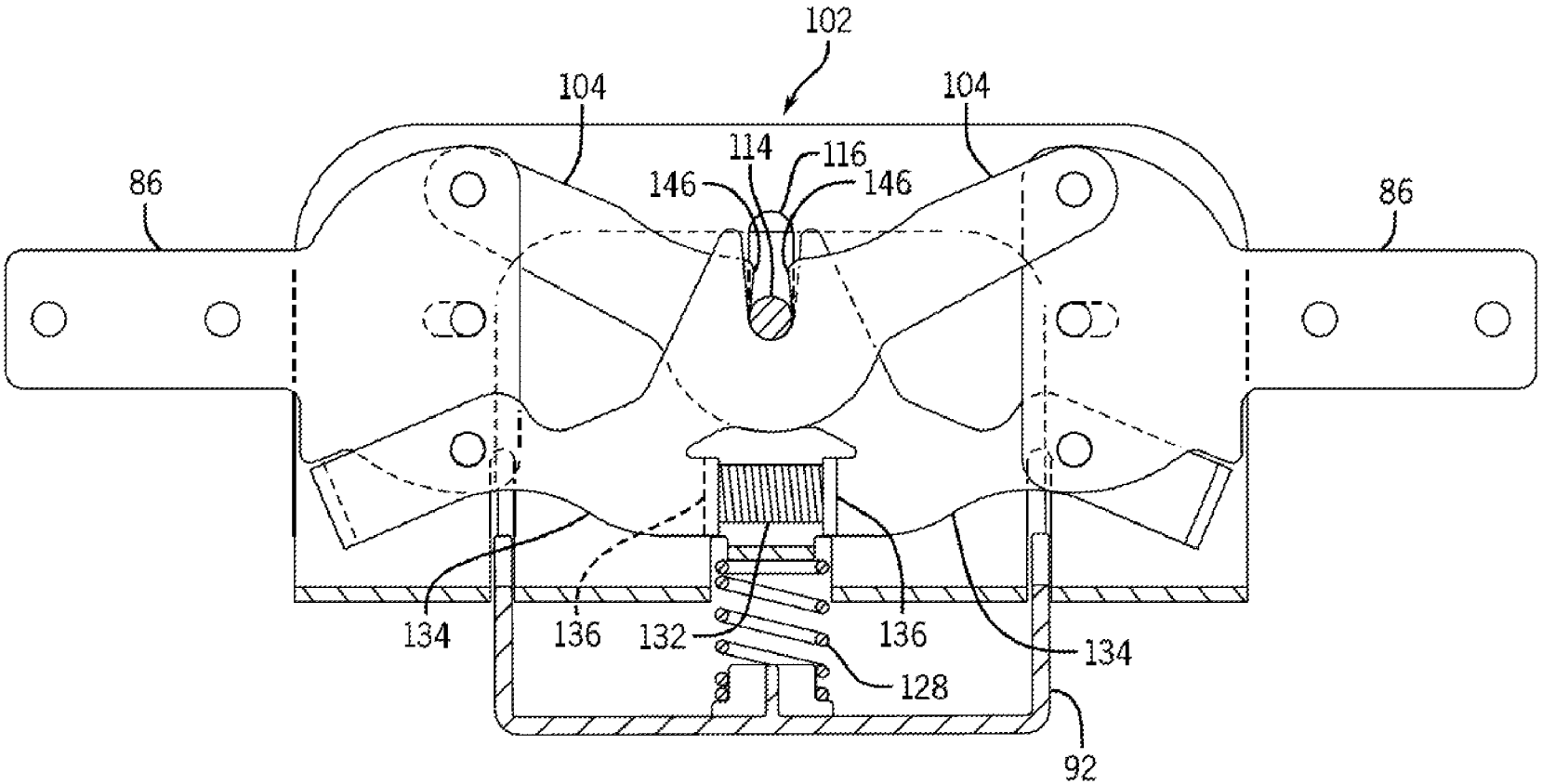
FIG. 5 is an elevational, cutaway view of the latch assembly of FIG. 2 in a latched state for an in-use or set-up orientation of the playard of FIG. 1.

FIG. 5 shows the linkage arrangement of the synchronized link latch 102 in the latched state. The crosslinks 104 form a dual, scissor-like interconnection between the rail connectors 84. In the latched state, the strips 134 cross one another near the slot 116 and compress the spring 132 between the tabs 136. The bias spring 128 is not compressed by an upward force on the actuator 92, and the latch pin 114 is disposed at a bottom end of the slot 116 as shown. The latch pin 114 is captured at that level in the slot 116 by the encroachment of the latch clasps 146 and the non-aligned nature of the channels 151 (FIG. 4) of the strips 134. Because the latch pin 114 cannot move upward in the slot 116 (or the channels 151), the latch assembly is secured in the latched state.

Figure 6:
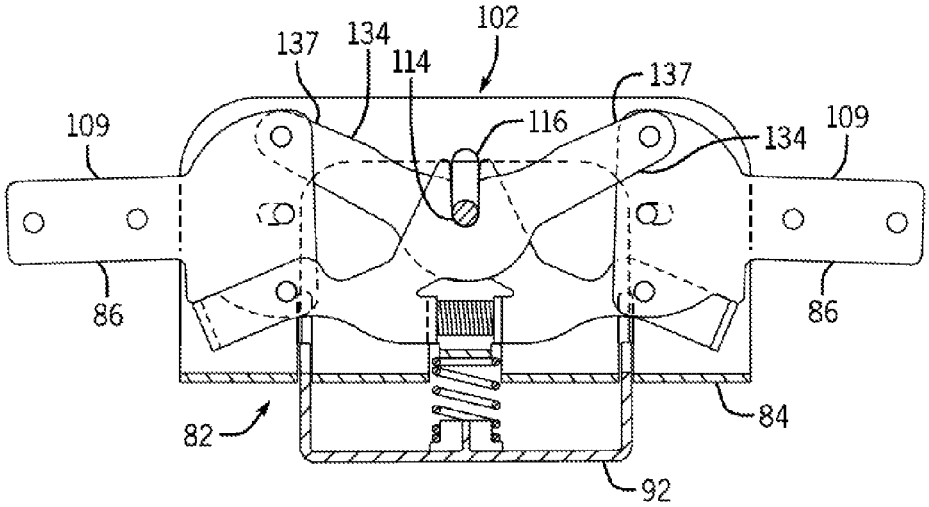
FIG. 6 is an elevational, cutaway view of the latch assembly of FIG. 2 after the latch assembly has been lifted or raised to a ready-to-release state in preparation for releasing or disengaging the latch assembly.

FIG. 6 shows the link latch 102 after the latch assembly 82 has been raised in preparation for releasing or disengaging the latch 102. The ready-for-release state is reached as a result of a user pulling slightly upward on the housing 84, the actuator 92, or the top rail sections 78 (FIG. 1). This upward movement rotates each rail connector 86 to a slightly downward extending orientation (e.g., the fingers 109 pointing slightly downward). The rotation of the rail connectors 86 pulls the end connectors 137 of each strip 134 laterally outward. The movement of the strips 134, in turn, adjusts the extent to which the latch clasps 146 (FIG. 5) protrude into the slot 116. Once the assembly has been raised sufficiently, the latch clasps 146 clear the slot 116, and the channels 151 are aligned with the slot 116, thereby opening an unobstructed pass-through large enough to allow the latch pin 114 captured therein to move upward. The link latch 102 is in the ready-to-release state.

Figure 7:
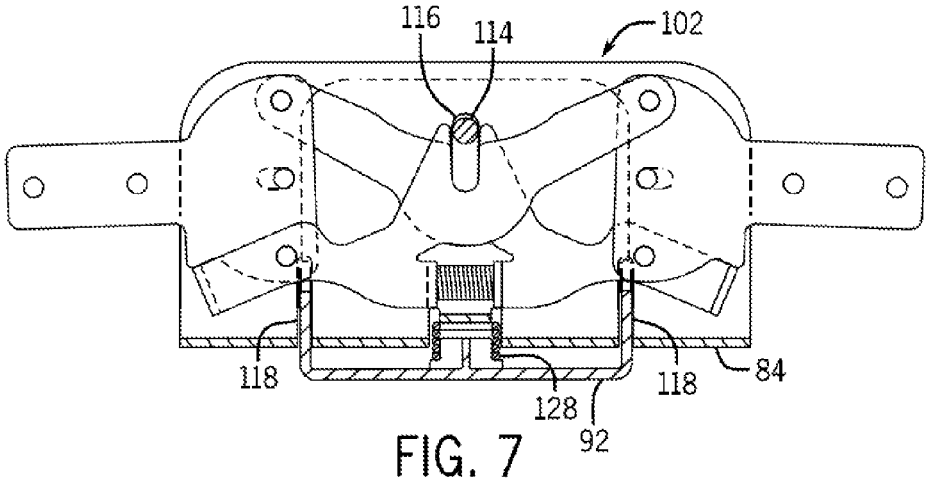
FIG. 7 is an elevational, cutaway view of the latch assembly of FIG. 2 as a release button is pushed or retracted to release or disengage the latch assembly.

With reference now to FIG. 7, upward movement of the actuator 92 drives the latch pin 114 upward to a raised position in the slot 116 as shown. The raised position of the latch pin 114 relative to each latch catch 146 (FIG. 5) releases the latch 102 from the latched state. FIG. 7 shows the link latch 102 after the actuator 92 has been pulled upward by a user to release the latch assembly. The upward release force overcomes the return force of the spring 128. As described above, the actuator 92 slides upward into the housing 84 via the slots 118. Because the latch pin 114 is fixed relative to the actuator 92, the latch pin 114 moves upward in the slot 116 a distance corresponding with the extent to which the actuator 92 is raised by the user.

Figure 8:
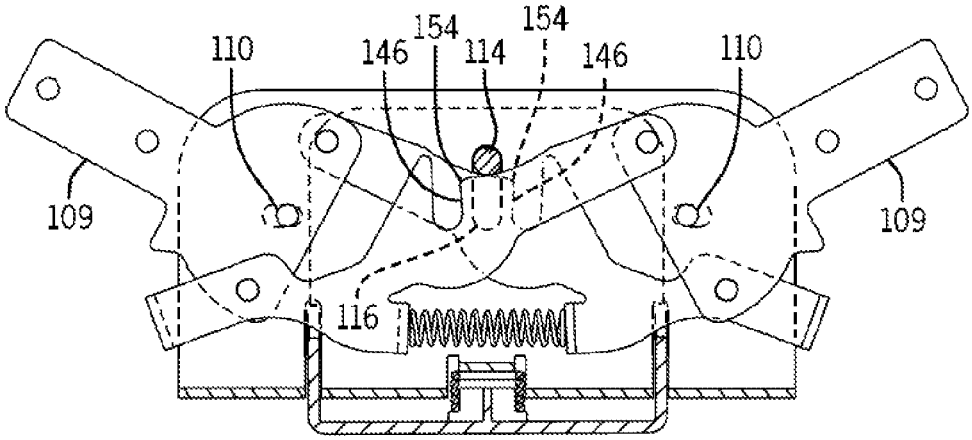
FIG. 8 is an elevational, cutaway view of the latch assembly of FIG. 2 in a released or disengaged state.

Once the latch pin 114 reaches an upper end of the slot 116 as shown in FIG. 8, the latch pin 114 clears an upper tip or corner 154 of each latch catch 146, thereby allowing the crosslinks 104 to move past the latch pin 114. The movement of each crosslink 104 is directed by the rotation of the rail connectors 86 about the pivot points 110. With that rotation, the end connectors 137 of the strips 134 slide inward and downward, and the fingers 109 of the rail connectors 86 turn to point upward. As a result, the latch assembly 76 lowers from the height shown in FIG. 1, drawing the top rail sections 78 (FIG. 1) down as well. With the latch assembly 76 lowered, a false latch condition is avoided. The modified orientation of the rail sections 78 may also be readily discernable to a caregiver, thereby also helping to prevent the false latch condition.

Figure 9:
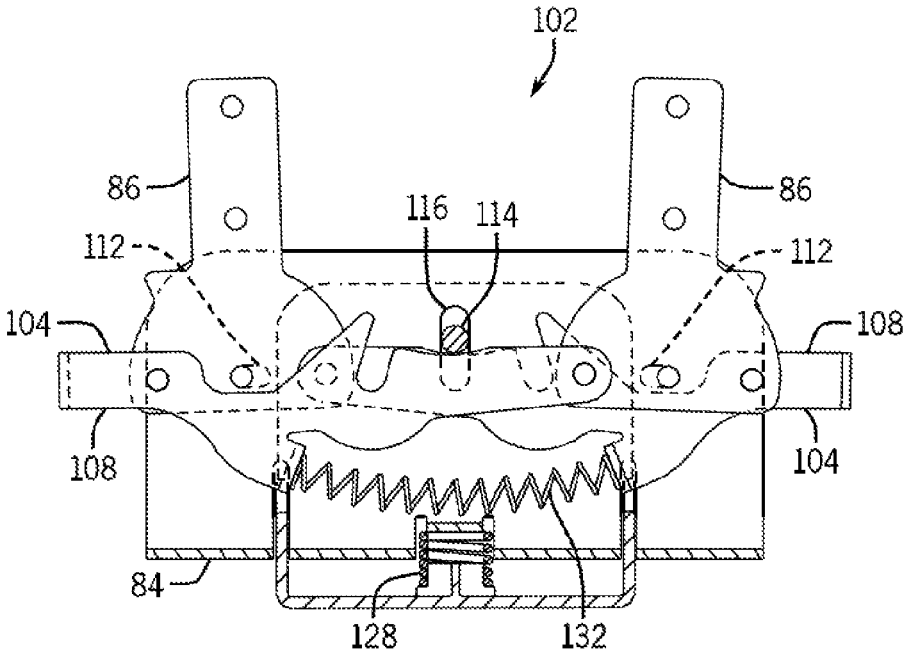
FIG. 9 is an elevational, cutaway view of the latch assembly of FIG. 2 with the top rails folded to a storage orientation of the playard of FIG. 1.

FIG. 9 depicts the state of the latch 102 once the playard 50 (FIG. 1) reaches its folded configuration. In this state, the rail connectors 86 are disposed in an inverted T-shape position. In this example, the heads 108 of the rail connectors 86 are positioned directly below the fingers 109, which now point upward in or near an upright orientation. The crosslinks 104 are now overlapping in a generally horizontal orientation. As a result, the crosslinks 104 are arranged such that the respective longitudinal directions of the crosslinks 104 are now roughly the same.

In this example, the mounting holes 112 are laterally extended or slotted. The slotted nature of the mounting holes 112 allows the rail connectors 86 to slide as well as rotate. The lateral movement supports a more full range of motion for the rail connectors 86.

The spring 132 biases the link latch 102 toward the folded or released condition, i.e., away from the latched state. The spring 132 generally applies sufficient force so that the rail sections and/or latch assembly will drop or fall away from the latched state or the in-use orientation if the latch assembly is not fully engaged. Thus, motion by the user can overcome the spring force to compress the spring 132, open the channel for the latch pin 114, and allow the return spring 128 to pull the pin 114 downward to latch the assembly. However, if the user fails to attain a full latch, the pin 114 will not seat in the lower end of the slots 116 between the latch links 104 and the spring 132 will force the latch assembly toward the folded condition, thereby preventing a false latching condition.

Because the spring 132 is under tension at or near the in-use orientation, the force on the tabs 136 is biasing the plates away from the latched state. The spring 136 cannot move the plate tabs when the assembly is in the latched state. However, if the assembly is not fully latched, the spring has sufficient spring force to overcome resisting forces such as the geometry of the rail sections and the tension in the soft goods. As a result, the latch assembly is unstable near the latched state, with the spring 132 pushing the latch assembly away from the latched state to the position shown in FIG. 8. For these and other reasons, the above-described components of the latch assembly may be considered to behave as an over-center system at points near the latched state. Once the latch assembly is pushed away from the latched state, the eventual positions of the latch assembly and the top rail construction are indicative to a user that the rail section is not latched. In this way, a false latching condition is inhibited and avoided.

Figure 10:
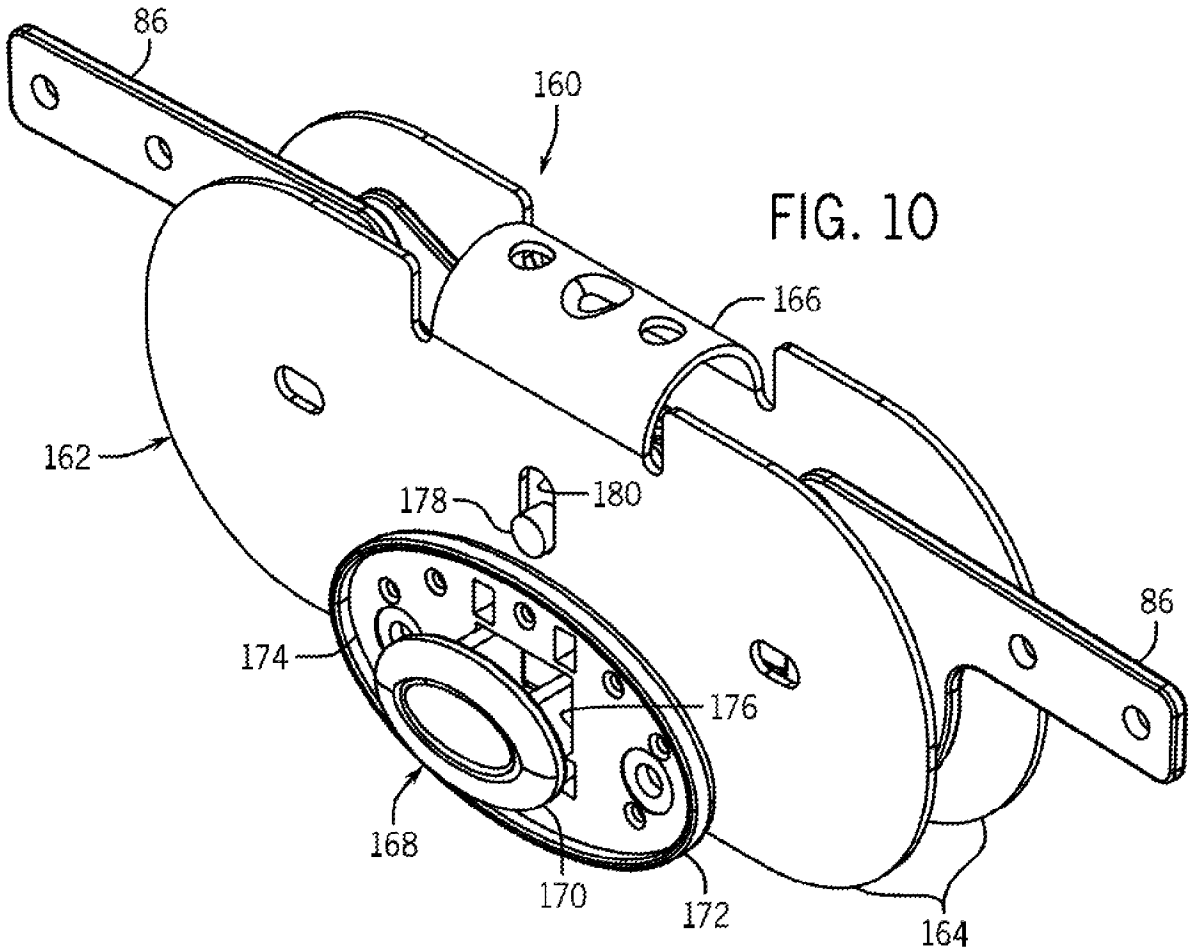
FIG. 10 is a perspective front view of an exemplary spring-biased latch assembly for one of the top rails of FIG. 1 in accordance with another embodiment.

FIG. 10 depicts an alternative latch assembly 160 for coupling the top rail sections 78 (FIG. 1) in a manner that also prevents false latch conditions. The assembly 160 includes a housing 162 from which the pair of spaced apart rail connectors 86 extend laterally from open sides of the housing 162. The latch assembly 160 and the rail connectors 86 are shown in a set-up orientation of the playard and, thus, the latched state of the latch assembly 160. Each rail connector 86 may be configured as described above in connection with the embodiment of FIGS. 2-9. The housing 162 in this example has a pair of opposing, spaced apart faceplates 164 (e.g., front and rear faceplates) that cover the internal components of the assembly 160 while leaving the bottom, top, and lateral sides largely open or exposed. An upper link 166 is centrally disposed along the top side of the housing 162. The upper link 166 connects the faceplates 164 to one another and, in some cases, may be integrally formed therewith. For example, the faceplates 164 and the upper link 166 may be made from a single, continuous piece of sheet metal roughly folded over in half as described above in connection with the housing of the previous embodiment. Together, the faceplates 164 and the upper link 166 form a shell or bracket that contains the components of the latch assembly 160. The upper link 166 may be bent or otherwise formed into an arch shape, rising upward from each faceplate 164 to provide clearance for the movement of internal components of the assembly 160. As described below, the upper link 166 may act as a stop for a spring-biased release actuator 168.

In contrast to the above-described embodiment, the release actuator 168 projects forward from one of the opposed faceplates 164 to provide a mechanism for releasing the latch assembly 160. The actuator 168 includes a pushbutton 170 slidably coupled to the housing 162 to enable a user to depress the pushbutton 170 to release the assembly 160 from the latched state. To that end, the actuator 168 also includes a receiver 172 mounted and laterally centered on the one of the two faceplates 164 through which the pushbutton 170 slides. The receiver 172 includes a front or mounting face 174 with a central hole 176 in which the pushbutton 170 is captured. In operation, depressing the pushbutton 170 inward toward the housing 162 drives a latch pin 178 upward within slots 180 in the faceplates 164. Eventually, the upward travel of latch pin 178 causes the latch assembly 160 to become disengaged, releasing the latch assembly 160 and top rail construction from the setup orientation shown. Further details regarding the operation of the latch assembly 160 are provided below.

Figure 11:
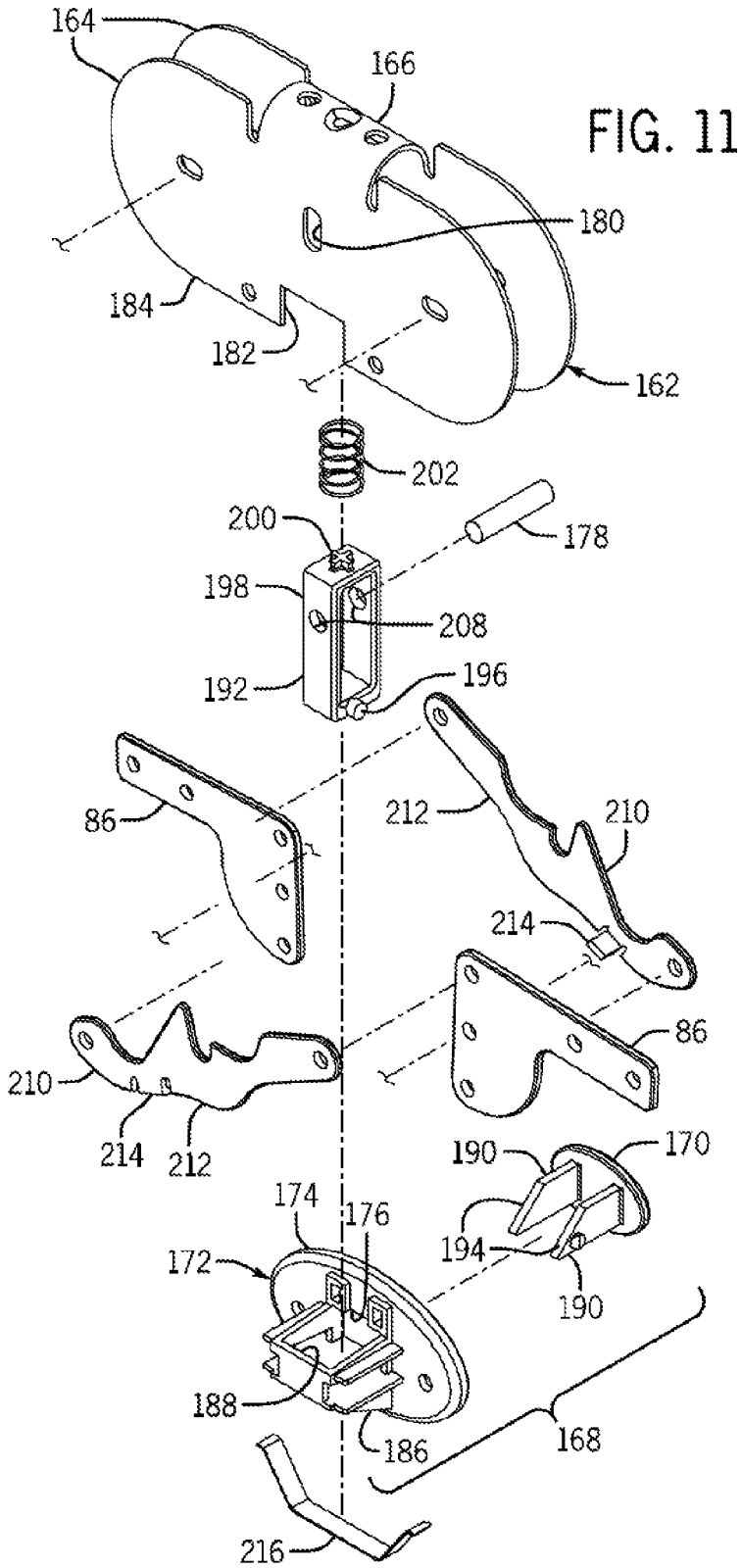
FIG. 11 is an exploded view of the latch assembly of FIG. 10 to depict a synchronized dual latch of the latch assembly of FIG. 2 biased to prevent false latch conditions in accordance with several aspects of the disclosure.

Turning now to FIG. 11, each faceplate 164 of the housing 162 includes a notch 182 formed in a lower edge 184 of the faceplate 164. The notch 182 is generally shaped to capture the receiver 172 of the release actuator 168. To that end, the receiver 172 includes a frame 186 that extends rearward from the mounting face 174. The frame 186 is inserted through each notch 182 for a pressure fit or other engagement of the faceplates 164. The configuration of the frame 186 may vary considerably from the example shown, along with the nature of the engagement or coupling of the actuator 168 and the housing 162. In this example, the frame 186 defines a central cavity 188 configured to receive the pushbutton 170 as it passes through the hole 176.

The pushbutton 170 of the actuator 168 includes a pair of spaced apart wedges or fingers 190 that extend into the cavity 188 to an extent that varies as the button 170 is pushed inward. Each wedge or finger 190 may be configured as an upstanding wall as shown that slides past inner sides of the frame 186. The upright wall orientation of the fingers 190 helps to contain a riser or shuttle 192 that travels vertically within the cavity 188. Generally speaking, the shuttle 192 works in conjunction with the fingers 190 to translate the horizontal motion of the pushbutton 170 into vertical motion used to disengage the latch assembly 160. To that end, each wedge or finger 190 terminates in an inclined edge 194 that forms a ramp upon which the shuttle 192 rides or slides. In this example, one or more lifters 196 project laterally outward from a bottom end of a frame 198 of the shuttle 192 to engage the inclined edge(s) 194. Each lifter 196 in this example is a pin- or rod-shaped lateral extension from the bottom end of the shuttle frame 198. These components generally form a riser assembly driven by the actuator 168 that may vary considerably from the example shown.

The frame 198 of the exemplary shuttle 192 shown in FIG. 11 is shaped as an elongate box with open lateral sides. The frame 198 may be a molded, one-piece component. A top side of the frame 198 has a spring guide 200 to provide lateral support for a coil spring 202 that biases the shuttle 192 downward. In this example, the spring 202 bears against an underside of the crosslink 166 of the housing 162 to provide a return force for the actuator 168. To disengage the latch assembly 160, an inward force applied by a user to the pushbutton 170 drives the shuttle 192 upward, causing the latch pin 178 to travel upward in the slots 180 in the faceplates 164. The pin 178 is captured in a pair of pin holes 208 in the side walls of the shuttle frame 198, extending outward from the shuttle 192 to extend between the faceplates 164 in a manner similar to that described above. The spring 202 accordingly also defines the force a user must overcome when pushing the button 170 inward to disengage the latch assembly 160.

The riser assembly and other functional components of the latch assembly 160 are housed and suspended between the faceplates 164. The faceplates 164 and, more generally, the housing 162 form a shell or bracket with a generally open top and open lateral sides to allow the rail connectors 86 to move during folding and unfolding. The open-ended nature of the housing shell, the folded-over sheet construction, the shape and orientation of the base and faceplates, and other characteristics of the housing 84 are similar to the above-described example, but may vary considerably from the example shown.

The latch assembly 160 includes a dual, synchronized link latch disposed within the housing 162 between the faceplates 164 and configured in a manner similar to the above-described example. A pair of spaced apart latch crosslinks 210 are disposed between the faceplates 164 of the housing 162 and oriented to extend laterally between the rail connectors 86. As described above, the crosslinks 210 are coupled to the rail connectors 86 in what may be considered a four-bar linkage configuration. More generally, the crosslinks 210 interconnect the rail connectors 86 to synchronize the movement of the connectors 86 during latch release and folding operations. In this example, the crosslinks 210 engage the latch pin 178 as the crosslinks 210 pass through the open sides of the shuttle frame 198. Each crosslink 210 may be configured as an elongate strip of, for instance, sheet metal, and is generally similar in other respects (e.g., shape, orientation, construction, disposition relative to other components, coupling, etc.) to the example described above. The crosslinks 210 differ from the above-described embodiment in at least one respect, insofar as a lower edge 212 of each crosslink 210 includes a tab 214 bent to extend inwardly from the plane in which the crosslink 210 lies. Each tab 214 is generally configured to project sufficiently inward to engage a leaf spring 216 as the latch assembly 160 moves toward the latched state. Each tab 214 may extend inward at a point along the length of the crosslink 210 that causes the leaf spring 216 to become less flat as the spring 216 is placed under tension. Each tab 214 may be oriented at a variety of angles relative to the lower edge 214 and strip plane of the crosslink 210. The position, orientation, shape, size, and other characteristics of the tabs 214 may vary considerably from the example shown. For example, the tabs 214 may be oriented such that a top face, rather than side edge, is engaged by the leaf spring 216, as shown in FIGS. 12 and 13.

The leaf spring 216 is disposed within the housing 162 to provide the bias force that places the latch assembly 160 under tension as it nears and enters the latched state. The spring 216 generally pushes the tab 214 of each crosslink 210 laterally outward, which tends to decrease the inclination of the crosslinks 210. As a result, the crosslinks 210 move away from the latched position, and the latch assembly 160 avoids residing in a nearly latched, or false latch, condition.

Figure 12:
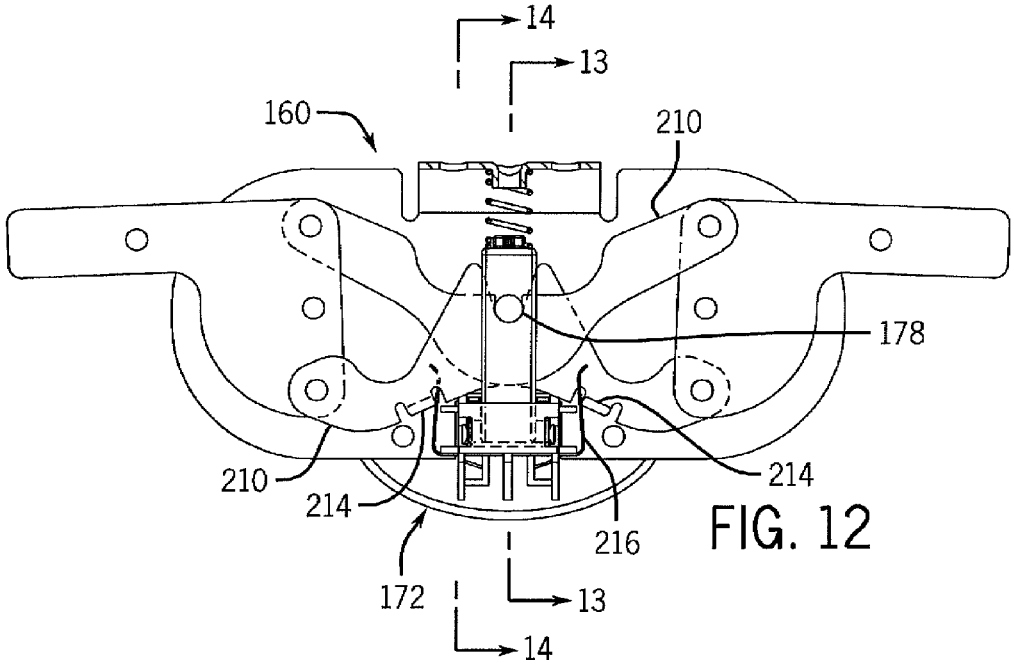
FIG. 12 is an elevational, cutaway view of the latch assembly of FIG. 10 in a latched state for an in-use or set-up orientation of the playard of FIG. 1.
Figure 15:
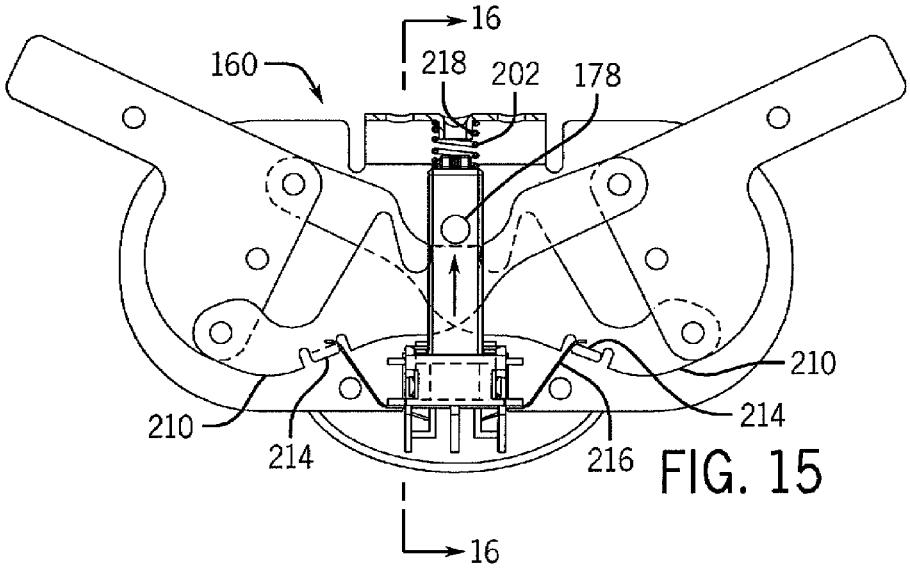
FIG. 15 is an elevational, cutaway view of the latch assembly of FIG. 10 in a released or disengaged state.
Figure 13:
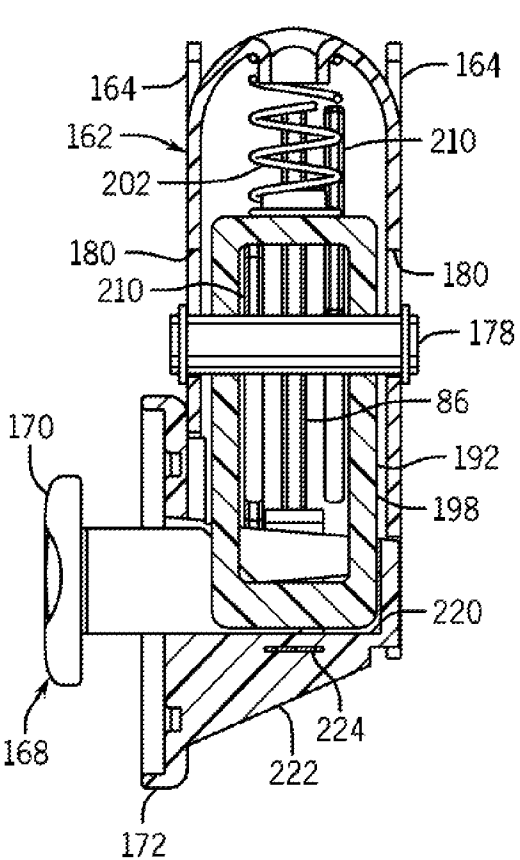
FIG. 13 is a sectional view of the latch assembly of FIG. 10 taken along lines 13-13 in FIG. 12 to depict an actuator and a riser assembly of the latch assembly in the latched state.

FIGS. 12 and 15 depict the positioning of the crosslinks 210 in the latched state and unlatched state, respectively. The latch pin 178 engages each crosslink 210 when the latch assembly 160 is in the latched state, maintaining the relative orientation of the crosslinks 210 shown in FIG. 12. The travel of the latch pin 178 within the slots 180 (FIG. 11) is restricted by the crosslinks 210 when the assembly is fully latched, thereby preventing an unintentional disengagement of the latch assembly 160. Comparing the operational states shown in FIGS. 12 and 15, the leaf spring 216 is compressed by the tabs 214 as the playard moves from the folded configuration to the in-use configuration. In this way, the leaf spring 216 bears against the tabs 214 as the latch assembly 160 nears the latched state. The interaction of the spring 216 and the crosslinks 210 thus helps to prevent the top rail from entering a false latch condition by biasing the latch assembly 160 away from the latched state.

As shown in FIG. 12, the contour of each crosslink 210 restricts upward movement of the latch pin 178 in the latched state. In a manner similar to that described above, peaks or projections along the contour of each crosslink 210 define a latch catch and a reverse stop spaced from one another by a channel. Once the latch assembly 160 is raised slightly via a slight upward pull on the housing 162 or the actuator 168, the channels of the crosslinks 210 are aligned, and the latch catch of each crosslink 210 no longer obstructs upward movement of the latch pin 178. As a result, a user can move the latch pin 178 to the position shown in FIG. 13 with an inward push on the button 170. In this example, the upward push moves the shuttle 192 upward as shown in FIG. 15, which, in turn, compresses the bias spring 202 about a latch guide 218 that projects downward from the upper link 166.

Figure 16:
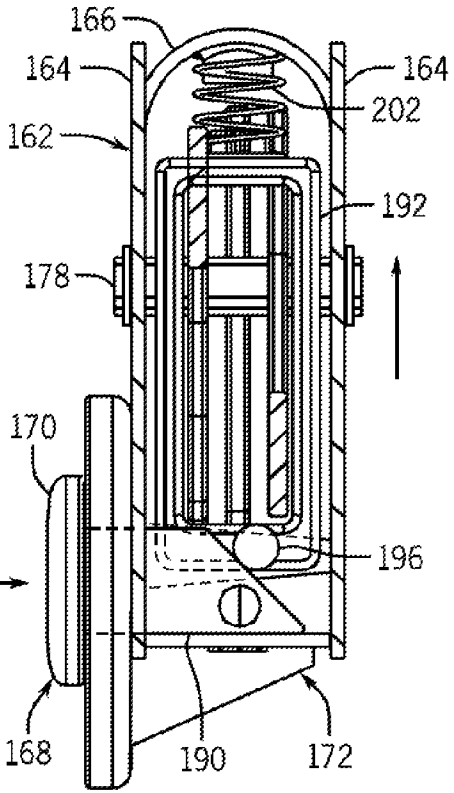
FIG. 16 is a sectional view of the latch assembly of FIG. 10 taken along lines 16-16 in FIG. 15 to depict the actuator and the riser assembly of the latch assembly in the released state.
Figure 14:
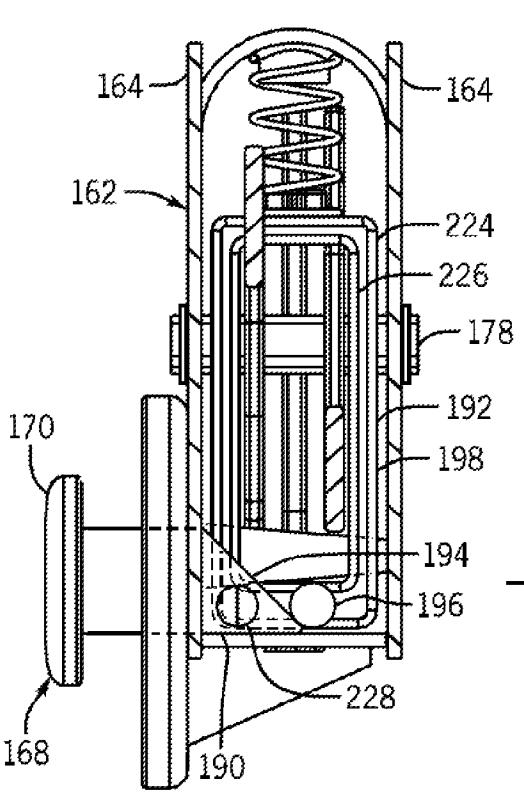
FIG. 14 is a sectional view of the latch assembly of FIG. 10 taken along lines 14-14 in FIG. 12 to depict the actuator and the riser assembly of the latch assembly in the latched state.

The operation of the actuator 168 is shown in greater detail in FIGS. 13, 14, and 16. In the example shown, the actuator 168 is generally configured to act on a riser assembly that includes the shuttle 192. The riser assembly, in turn, acts on the latch pin 178, the movement of which disengages the latch assembly 160, thereby allowing the crosslinks 210 to move from the in-use orientation to the folded orientation.

FIG. 13 shows the latch assembly 160 in the latched state with a sectional cut through the center of the riser assembly. In the latched state, the actuator 168 disposes the riser assembly in a lower position in which the latch pin 178 remains engaged with the crosslinks 210. To that end, the button 170 is spaced from the housing 162 such that the wedge 190 (or inclined edge 194 thereof) does not push upward on the shuttle 192 of the riser assembly. Instead, the bias spring 202 pushes downward on the shuttle housing 198. In this example, the shuttle housing 198 rests on a floor or base 220 of the receiver 172 of the actuator 168. The floor 220 is supported by one or more upright support beams 222. These and other components of the receiver 172 may be integrally formed. The leaf spring 216 (FIG. 11) may be captured within a slot 224 through the support beam(s) 222. With the shuttle 192 positioned downward as shown, the latch pin 178 resides at the lower end of the slots 180, and remains engaged by each crosslink 210 as shown in FIG. 12. The engagement of one of the crosslinks 210 can be seen in FIG. 13, as it extends both above and below the latch pin 178. A portion of the other crosslink 210 is visible in FIG. 13, which depicts one of the peaks or projections (in this case, the reverse stop) extending above the latch 178. Each crosslink 210 is spaced outward from the rail connector 86, which is essentially disposed between the plates 164. The slot 180 in each plate 164 is also shown with the latch pin 178 captured therein.

FIG. 14 is a sectional cut offset from center to reveal the engagement of the riser assembly and the actuator 168 while the latch assembly 160 resides in the latched state. The latch pin 178, the shuttle 192, the pushbutton 170, and other components remain in the same positions shown in FIG. 13. The inclined edge 194 of one of the wedges 190 of the actuator 168 is now shown extending into the housing 162 to engage the lifter 196 on the shuttle frame 198. The lifter 196 need not be pin- or rod-shaped as shown, but more generally have any shape or orientation that supports movement up the ramp of the inclined edge 194. In this example, the lifter 196 is positioned and sized to extend between outer and inner walls 224, 226 of the shuttle frame 198 along a bottom side thereof. Each wedge 190 includes a travel limiter or stop 228 that projects laterally outward from the upright plane of the wedge 190. The stop 228 prevents removal of the pushbutton 170 via impact with one of the plates 164.

FIG. 16 shows how the actuator 168 and the riser assembly disengage the latch assembly 160. To that end, FIG. 16 depicts the latch assembly 160 along the same sectional cut as FIG. 14, but with the latch assembly 160 in the unlatched state (i.e., the positioning shown in FIG. 15). To disengage the latch assembly 160, a user pushes the pushbutton 170 inward, causing the wedge 190 to extend farther into the housing 162. In this position, the inclined edge 194 may, for example, reach the distal side of the cavity defined by the actuator receiver 172, or the rear plate 164. The insertion of the wedge 190 allows the inclined edge 194 to act as a ramp for the lifter 196, which slides or rides up the inclined edge 194 as shown. The lifter 196, in turn, raises the rest of the shuttle 192, compressing the bias spring 202 as the spacing between the shuttle frame 198 and the upper link 166 decreases. The upward movement of the riser assembly eventually positions the latch pin 178 at or near the top of the slots 180 (FIG. 13), no longer captured within the channels defined by the crosslinks 210. As a result, the crosslinks 210 are no longer held in place by the latch pin 178, and are free to slide and move as described above to reorient the rail connectors 86 toward the folded position, as shown in FIGS. 15 and 16. Once the crosslinks 210 are released, the operation of the latch assembly 160 proceeds as set forth in connection with the above-described example. The movement of the rail connectors 86 is synchronized via the crosslinks 210, and the leaf spring 216 (FIG. 15) biases the rail connectors 86 and the latch assembly 160 away from the latched state to avoid false latch conditions.

In the example of FIGS. 10-16, the leaf spring 216 may also act as a reverse stop to prevent the rail connectors 86 from rotating too far in the wrong direction from the latched state. As best shown in FIG. 12, the leaf spring 216 may be blocked from further compression by the actuator receiver 172.

Figure 17:
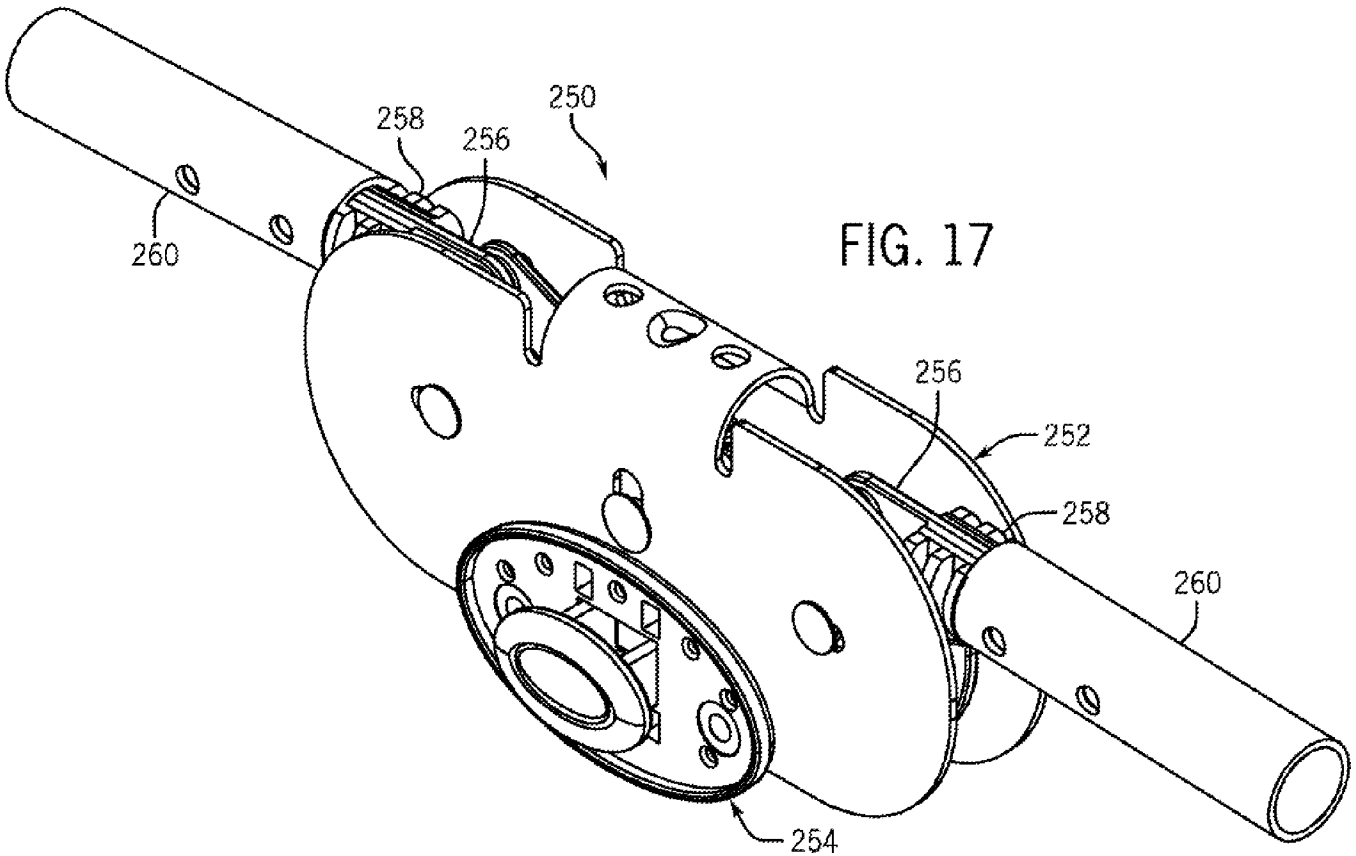
FIG. 17 is a perspective front view of an exemplary spring-biased latch assembly for one of the top rails of FIG. 1 in accordance with yet another embodiment.

With reference now to FIG. 17, an exemplary latch assembly 250 is constructed and configured accordance with the disclosure. In many ways, the latch assembly 250 is similar to the leaf spring embodiment described in connection with FIGS. 10-16. For instance, a housing 252 and an actuator 254 may be identical or similar to the corresponding components of the leaf spring embodiment. The two embodiments may also use the same riser assembly and rail connectors. In this case, rail connectors 256 are shown with respective rail inserts 258 configured to engage each connector 256 for coupling with a corresponding top rail 260. Further details regarding the rail inserts 258 are provided below in connection with FIG. 22. The two embodiments may differ, however, in other ways, including the bias element or arrangement (e.g., the manner in which the latch assembly 250 is biased away from the latched state). The bias element of this embodiment allows the crosslinks to be used for synchronization and latching without false latch biasing. As described below, the false latch biasing function is provided in a manner separate from the crosslinks.

Figure 18:
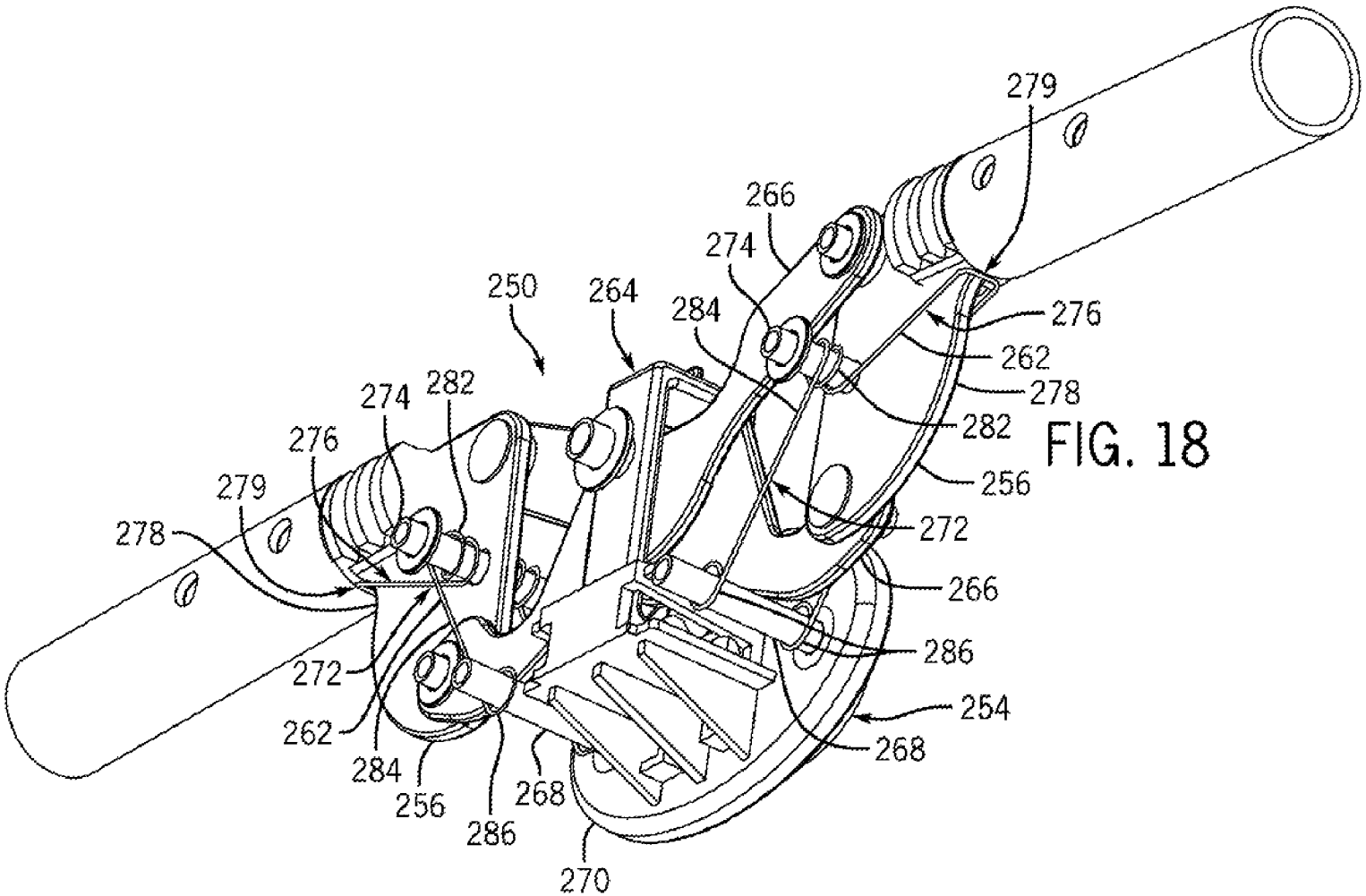
FIG. 18 is a perspective, cutaway bottom view of the latch assembly of FIG. 17 to depict a torsion spring arrangement of a synchronized dual latch biased to prevent false latch conditions in accordance with several aspects of the disclosure.

FIG. 18 shows the latch assembly 250 without the housing 252 (FIG. 17) to reveal the biasing arrangement. One aspect of the biasing arrangement involves the use of mounting pins or rods already in place for the purpose of securing other components in place within the housing 252. Another aspect of the biasing arrangement involves the engagement and biasing of the rail connectors 252 rather than some other component of the latch assembly 250. In this way, the biasing arrangement acts more directly on the rail connectors 252 and, thus, the top rails, to prevent a false latch condition.

The embodiment of FIG. 18 uses a torsion spring biasing arrangement to prevent false latch conditions. In the example shown, the latch assembly 250 includes a pair of torsion springs 262 disposed within the housing 252 on either side of a riser assembly 264, one spring for a corresponding one of the rail connectors 256. Each spring 262 is generally configured to engage the corresponding rail connector 256 to drive and bias the rail connector 256 away from the latched state. In this case, the torsion springs 262 are configured to act directly on the rail connectors 256. Applying the bias force to the rail connectors 256 differs from the bias arrangements of the above-described embodiments, which, in contrast, apply a bias force to the rail connectors indirectly via latch crosslinks. The latch assembly 250 also includes a pair of crosslinks 266 for the other purposes described above, namely synchronizing the movement of the rail connectors 256 and controlling the disengagement of the latch assembly 250. With those traits in common, the crosslinks 266 may be configured similarly to the crosslinks of the above-described embodiments, albeit without the spring engagement tabs described above.

Each torsion spring 262 is configured to define a path that extends from at least one fixed end to a free or biasing end that engages the rail connector 256. In this example, the free or biasing end of each torsion spring 262 wraps around the corresponding rail connector 256 such that the path forms a loop. The path may begin and end at a pair of fixed ends located at a common fixed base. In this case, for each torsion spring 262, the fixed base is a mounting pin 268 that secures a faceplate 270 of the actuator 254 to the housing 252. A fixed or stationary section 272 of the spring path extends from the mounting pin 268 to a pivot pin 274 that establishes the pivot axis for the corresponding rail connector 256. The torsion spring 262 wraps around the pivot pin 274 to create tension in a bias or movable section 276 of the spring path. The bias section 276 extends laterally outward and upward from the pivot pin 274 to reach and wrap around an outer edge 278 of the rail connector 256. The bias section 276 may thus form a bail or U-shaped lever 279 under tension. The U-shaped lever 279 acts on the rail connector 256 to bias the rail connector 256 away from the latched state. With the U-shaped lever 279 wrapping around the rail connector 256, a robust engagement of the bias section 276 and the rail connector 256 is attained. In this example, the torsion spring 262 is configured to push the rail connector 256 to rotate in a direction that lowers the latch assembly 250, away from the latched state. As a result, the force is applied by each torsion spring 262 to the rail connector 256 at the position shown along the outer edge 278. The direction of the applied force is generally upward and laterally inward as the latch assembly 250 nears the latched state. The torsion spring 262 is configured such that, as the positioning or orientation of the rail connector 256 nears the latched state, the tension in the spring 262 increases.

Figure 19:
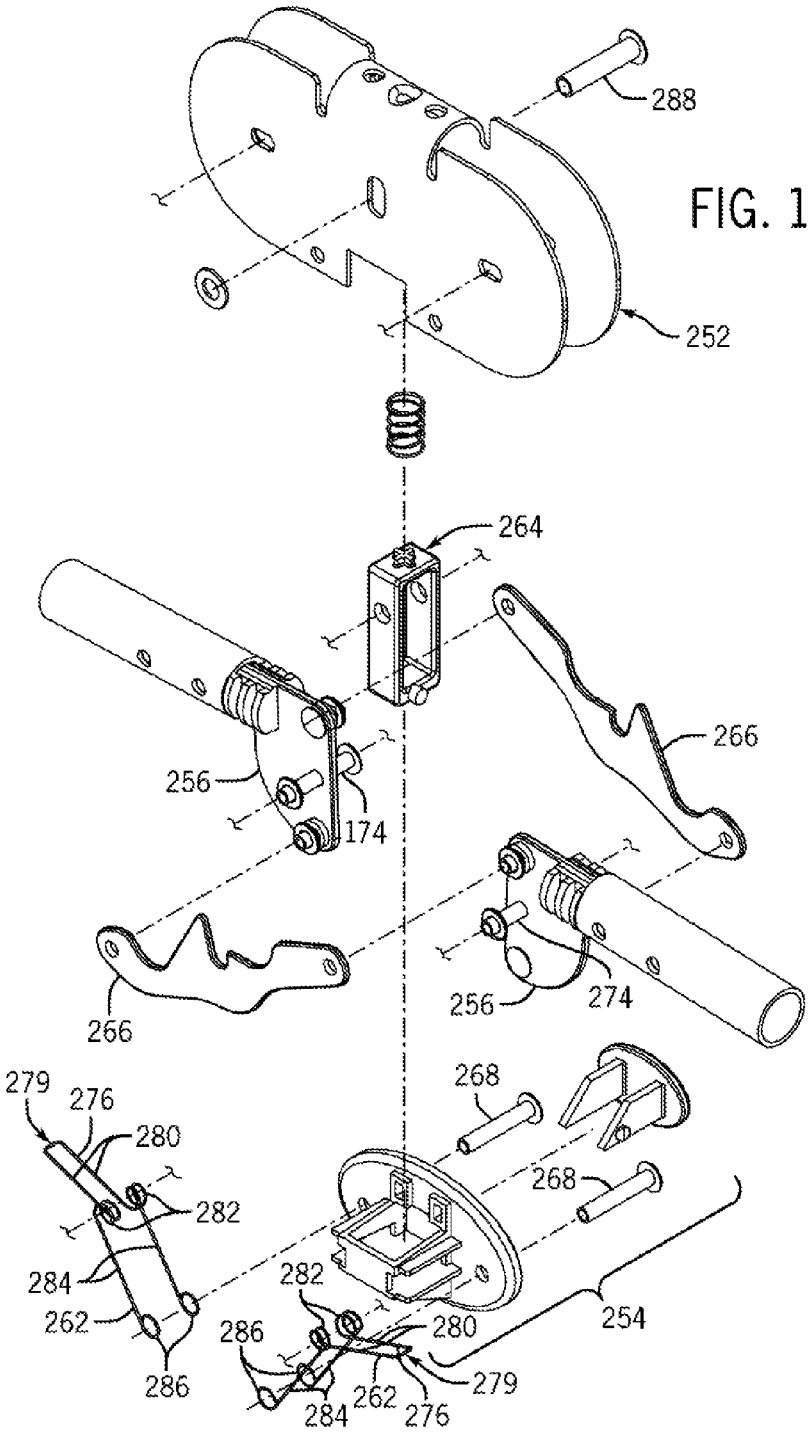
FIG. 19 is an exploded view of the latch assembly of FIG. 17 to depict the synchronized dual latch of the latch assembly of FIG. 17.

The biasing and fixed sections 272, 276 of the torsion spring 262 run along the rail connector 256 in the example shown as follows. Starting at the outer edge 278 of the rail connector 256, the bias section 276 bends or loops around the outer edge 278, thereby forming the U-shaped lever 279. As best shown in FIG. 19, arms 280 of the U-shaped lever 279 pass along a respective side face of the rail connector 256 until reaching the pivot pin 274. Each side of the spring 262 then winds or wraps around the mounting pin 274 to form a spring winding 282 that establishes and supports the tension in the bias section 276. After one or more winds or turns around the mounting pin 274, legs 284 of the fixed section 272 of the torsion spring 262 then pass along both sides of the rail connector 256 down to the mounting pin 268. Each leg 284 of the torsion spring 262 may then be secured to the mounting pin 268 in a variety of ways. In this example, each leg 284 of the torsion spring 262 terminates at a fixed, circular end loop 286.

The torsion spring biasing arrangement may vary from the example shown. For example, the mounting of the torsion spring 262 need not involve the pins 268, 274 or any other mounting, pivot, or other pin. The torsion spring 262 may be fixed to any stationary component of the latch assembly 250. Similarly, the winding 282 need not involve the pivot pin 274 or any other pin. Thus, other cases may involve a variety of different torsion spring mounting and biasing configurations and components, as well as spring paths differing from the loop-shaped path shown.

FIG. 19 shows the torsion springs 262 separated from the housing 252, the actuator 254, the rail connectors 256, the riser assembly 264, the crosslinks 266, and other components of the latch assembly 250. The exploded view of the latch assembly 250 more clearly shows the loop-shaped nature of the torsion springs 262. In this example, the U-shaped lever 279 of the bias section 276 is bent to include square corners, although rounded corners and other shapes may be used. The U-shaped lever 279 and remainder of each torsion spring 262 may be formed in a variety of ways, including as a wireform structure.

FIG. 19 also shows one example of how the crosslinks 266 may be simplified by virtue of the torsion springs 262 not engaging the crosslinks 266. In this case, the crosslinks 266 need not include tabs because the bias force is applied to the rail connectors 256. The contour of the crosslinks 266 may otherwise remain identical or highly similar to the crosslinks of the leaf spring embodiment described above. For example, the upper edge of the crosslinks 266 defines a latch catch (or clasp), a reverse stop, and a channel that captures a latch pin 288 as described above.

Figure 20:
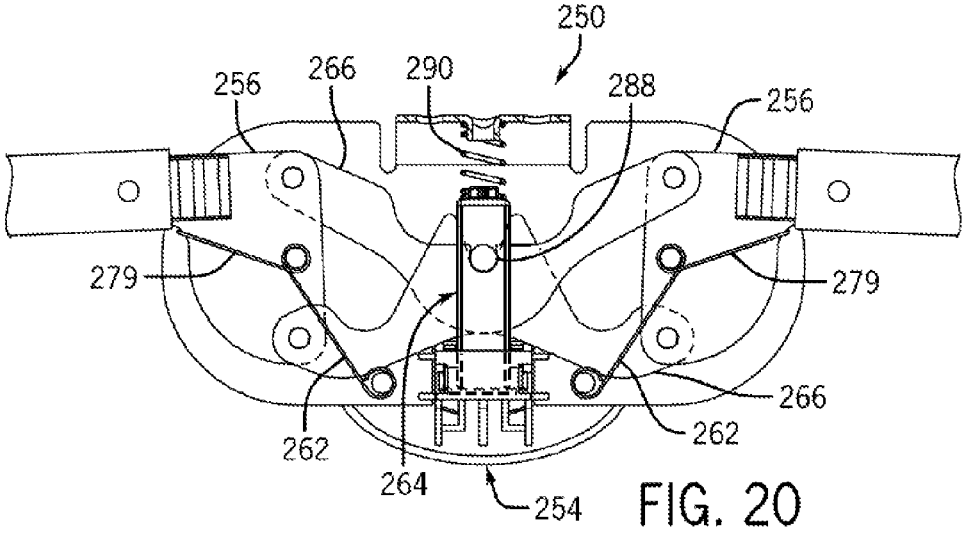
FIG. 20 is an elevational, cutaway view of the latch assembly of FIG. 17 in a latched state for an in-use or set-up orientation of the playard of FIG. 1.

Turning now to FIG. 20, the latch assembly 250 is shown in the latched state, in which the torsion springs 262 are under tension. The U-shaped lever 279 of each spring 262 is bent from a rest position such that the springs 262 act on the rail connectors 256 as described above. In this example, the U-shaped lever 279 is generally bent downward by the rail connector 256. The riser assembly 264 is biased to a lower position by a return spring 290, as the actuator 254 has not been used to raise the latch pin 288. As a result, the latch pin 288 remains captured in the channels formed by the crosslinks 266.

Figure 21:
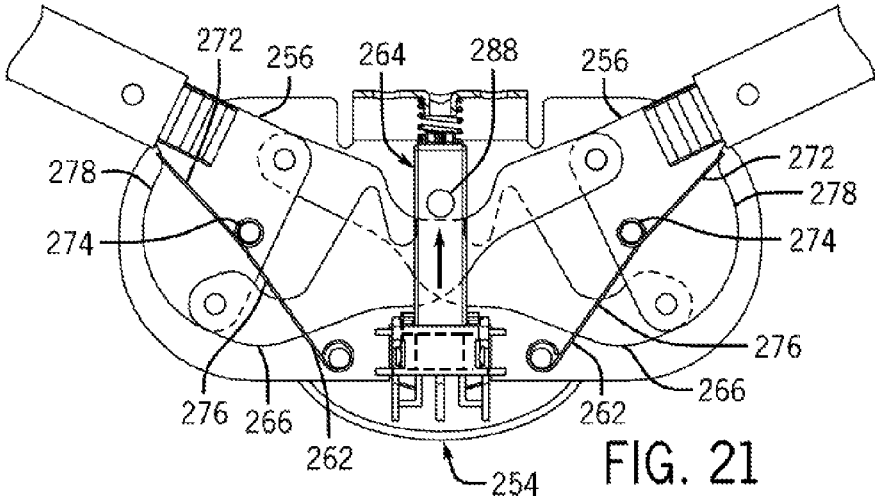
FIG. 21 is an elevational, cutaway view of the latch assembly of FIG. 17 in a released or disengaged state.

FIG. 21 shows the latch assembly 250 in the unlatched state. The actuator 254 and the riser assembly 264 have disengaged the latch assembly 250 as described above, in which the latch pin 288 is no longer captured in the crosslink channels. The crosslinks 266 are thus free to move and slide as the rail connectors 256 rotate about the pivot pins 274. The rotation relaxes the torsion springs 262 as each spring 262 moves toward or to a rest state in which less force is applied to the outer edge 278 of the rail connectors 256. The torsion springs 262 may be configured such that the relaxed or rest state corresponds with the orientation shown in FIG. 21, in which the sections 272, 276 of each spring 262 are generally oriented in a straight line. Alternatively, the torsion springs 262 may be configured such that the rest state corresponds with the biasing section 272 deflected relative to the fixed section 276 to any desired extent (e.g., with the U-shaped levers 279 oriented directly upright). In any case, the springs 262 ensure that the rail connectors 256 are pushed away from positions at or near the latched state of FIG. 20 to prevent the false latch condition.

Figure 22:
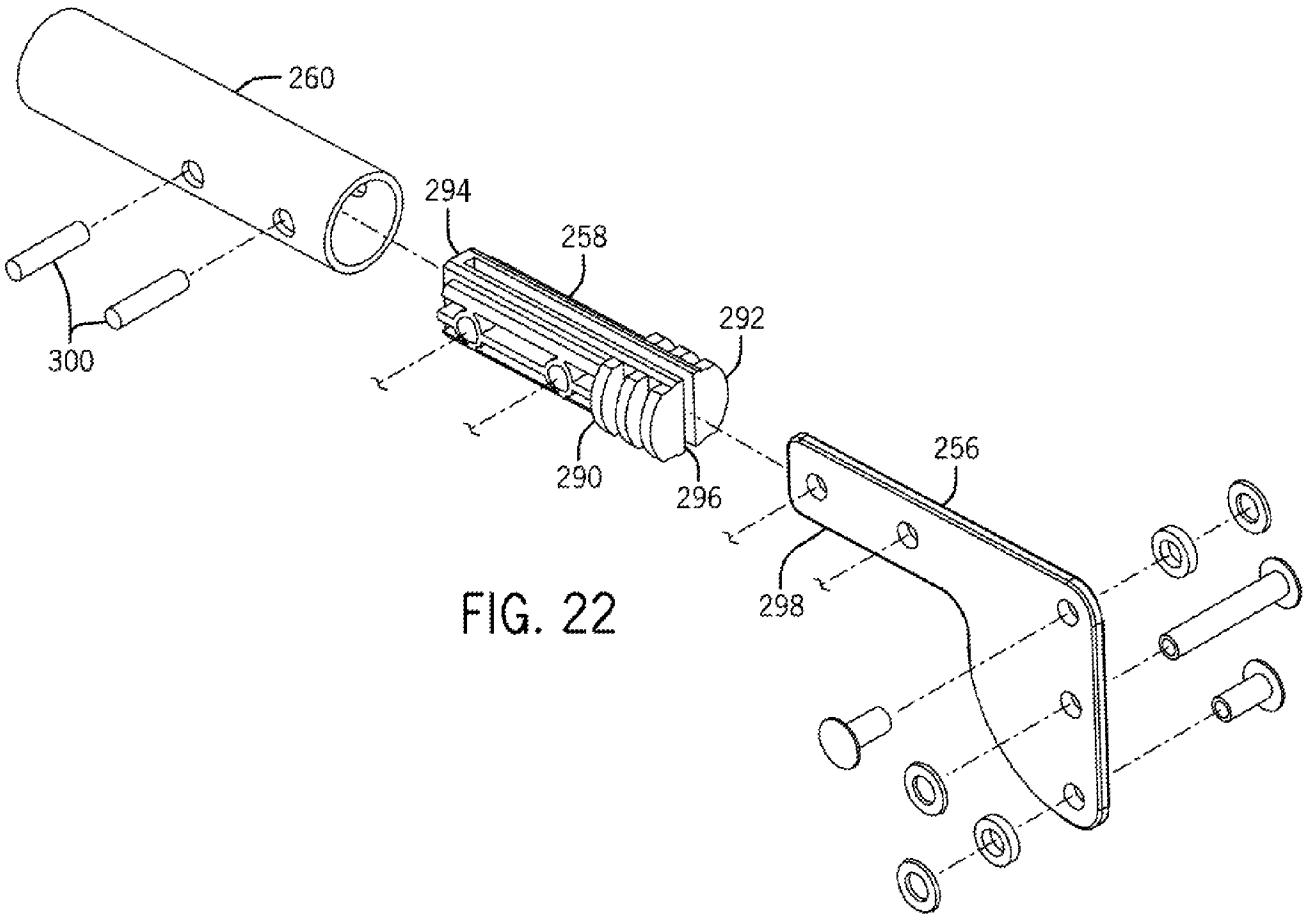
FIG. 22 is a perspective, exploded view of a rail connector of the latch assembly of FIG. 17 in accordance with one embodiment and for use with the exemplary latch assemblies of FIGS. 2 and 10.

With reference now to FIG. 22, the engagement of the rail connector 256 and the rail section 260 is shown in greater detail. Generally speaking, the insert 258 translates the plate-shaped nature of the rail connector 256 to the tube-shaped nature of the rail section 260. In this example, the insert 258 has a cylindrically shaped body 290 with an inner end 292 that engages the rail connector 256 and an outer end 294 that engages the rail section 260. To those ends, the inner end 292 has a slot or opening 296 configured to receive a finger 298 of the rail connector 256, while the outer end 294 has a generally cylindrical exterior matched to the diameter of the rail section 260. The slot 296 may extend almost the entire length of the insert 258 to securely capture the finger 298 and align fastener holes of the three components. Pins, rivets or other fasteners 300 may then be used to secure the rail connector 256 and the insert 258 in place within the rail section 260.

The exemplary rail connection arrangement shown in FIG. 22 provides one optional connection technique for use with any of the latch assembly embodiments described herein. A variety of other connection techniques may be used with each embodiment as desired.

In the examples shown in FIGS. 6-22, the linkage and other components of the latch assemblies may be made of metal. For example, the link latches, rail connectors, and latch housings may be made from sheet metal. These and other components may alternatively or additionally be made from other suitably durable materials that can be stamped, cut, or otherwise shaped as desired. The components of the above-described actuators may be formed as molded components.

The false latch prevention solutions described above generally involve the integration of the latch and biasing functions in a single device assembly. The integration allows the operation of the latch, as well as the movement of the top rail sections, to be synchronized. In other cases, the latch and biasing functions may be separated to varying extents while still safely ensuring that the latch assembly does not reach the false latch condition. The above-described examples also use different types of springs for the bias function. In other cases, the bias function may use any elastic or resilient element under tension at or near the latched state to act upon the latch mechanism or other component to drive the top rail away from the in-use or set-up orientation.

Figure 23:
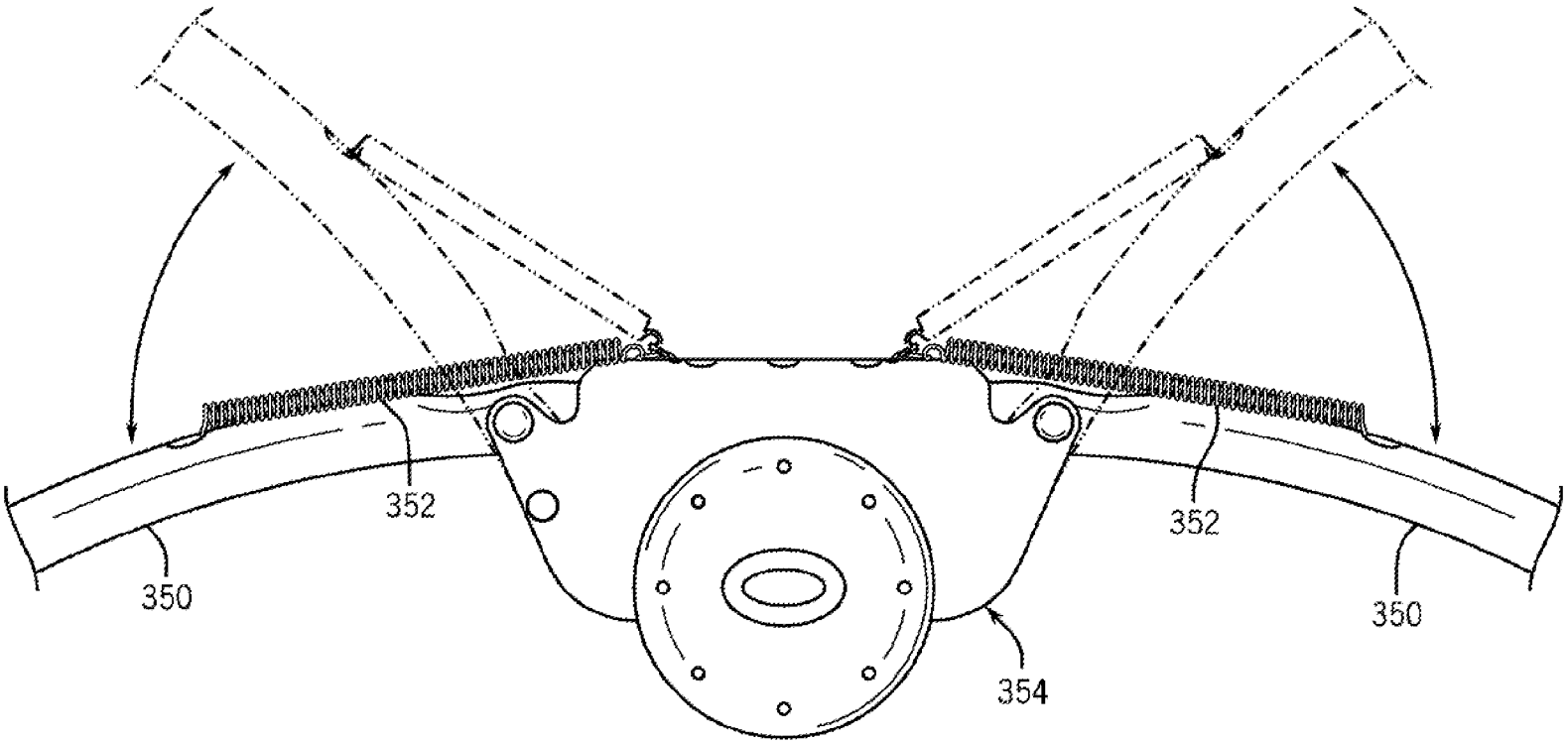
FIG. 23 is an elevational front view of an alternative spring-biased top rail latch assembly in a latched state and with another rail section in a released state shown in phantom.

One alternative solution for counteracting the false latching forces and geometry for curved top rail sections 350 is depicted in FIG. 23. In this example, a pair of coil springs 352 are disposed under tension along a top side of each top rail section 350. Each spring 352 is connected at one end to the top rail section 350 and at another end to a latching mechanism 354. With the springs 352 under tension, the springs 352 will tend to pull the latching mechanism 354 downward. If both the rail sections 350 are latched, the springs 352 cannot draw the latching mechanism 354 down. With both of the rail sections 350 unlatched, the springs 352 can assist folding the top rail sections 352 down until the spring tension is relaxed as shown in phantom. When attempting to latch the top rail sections 350, a user will pull up on the latching mechanism 354 to reach the raised position shown. If one of the rail sections 350 is not latched, the respective spring 352, having sufficient spring force to overcome the geometry and any soft goods tension, will pull the latching mechanism 354 downward, as shown in phantom. This will indicate to the user that the rail section 350 is not latched and can inhibit or avoid a false latching condition.

Figure 24:
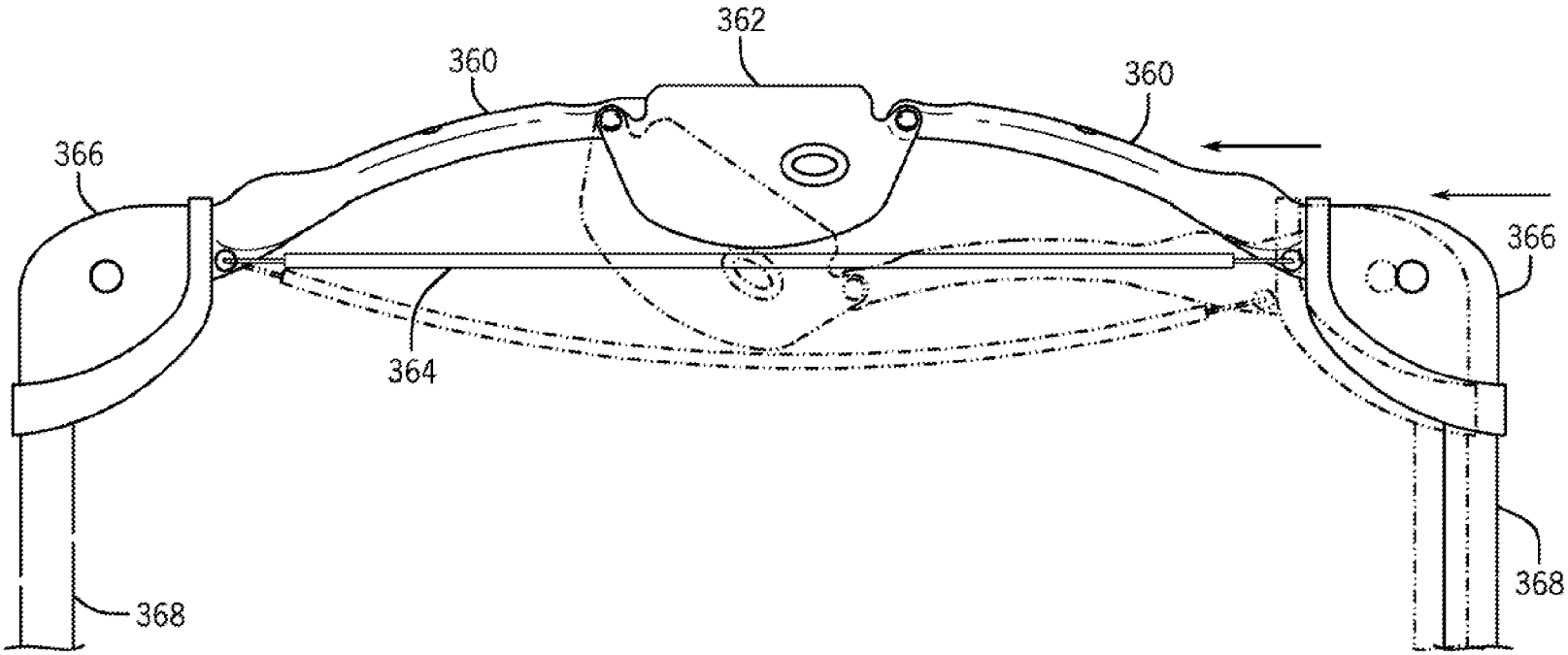
FIG. 24 is an elevational front view of another alternative spring-biased top rail latch assembly in a latched state and with another rail section in a released state shown in phantom.

FIG. 24 illustrates another alternative solution according to the teachings of the disclosure that can be employed with a pair of top rail sections 360 and a latching mechanism 362. In this example, a single spring or other resilient or elastic element 364 is positioned just below the latching mechanism 362 and is connected to the top rails sections 360. The spring 364 is connected under tension to the sections 360 above or inside of respective pivot joints 366 connecting the outer ends of the top rail sections 360 to corresponding legs 368 of the playard. If the latch mechanism 362 is not fully latched, the spring tension will pull the leg 368 inward, or toward the latch mechanism 362. As a result, the latch mechanism 362 is pulled downward as shown. Thus, the spring 364 will function similar to the springs described above, despite the use of only a single spring or other elastic element. In this case, the spring 364 still has the effect of drawing either or both sides of the latching mechanism 362 downward unless both of the top rails sections 360 are latched.

Figure 25:
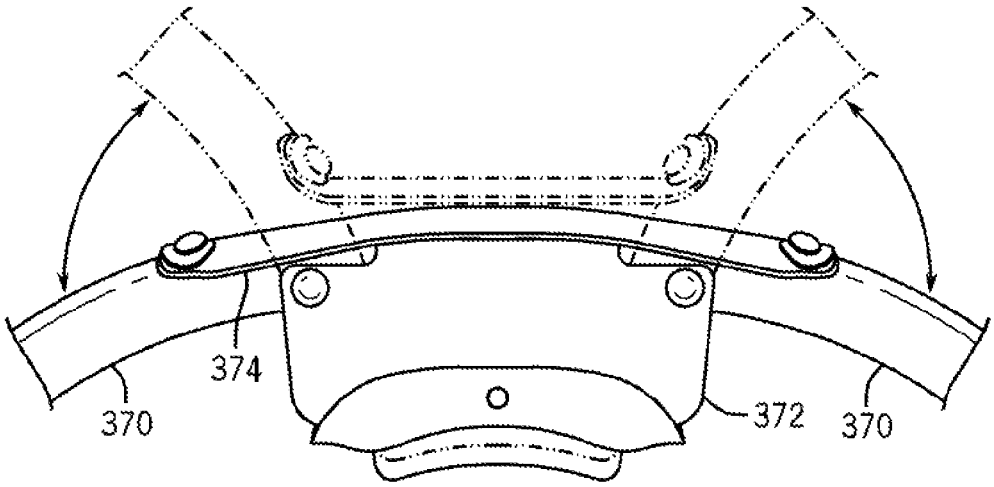
FIG. 25 is an elevational front view of yet another alternative spring-biased top rail latch assembly in a latched state and with another rail section in a released state shown in phantom.

FIG. 25 shows yet another alternative solution according to the teachings of the disclosure that can be employed with a pair of top rail sections 370 and a latching mechanism 372. This example also includes a single elastic strap or other resilient element 374. In this case, the elastic element 374 is coupled under tension to the tops of the rail sections 370 and disposed over the latching mechanism 372. The elastic element 374 relaxes as one or both of the rail sections 370 moves as shown. The strap 374 thus has the same biasing effect as the above-described springs despite involving only a single strap or other elastic element.

Figure 26:
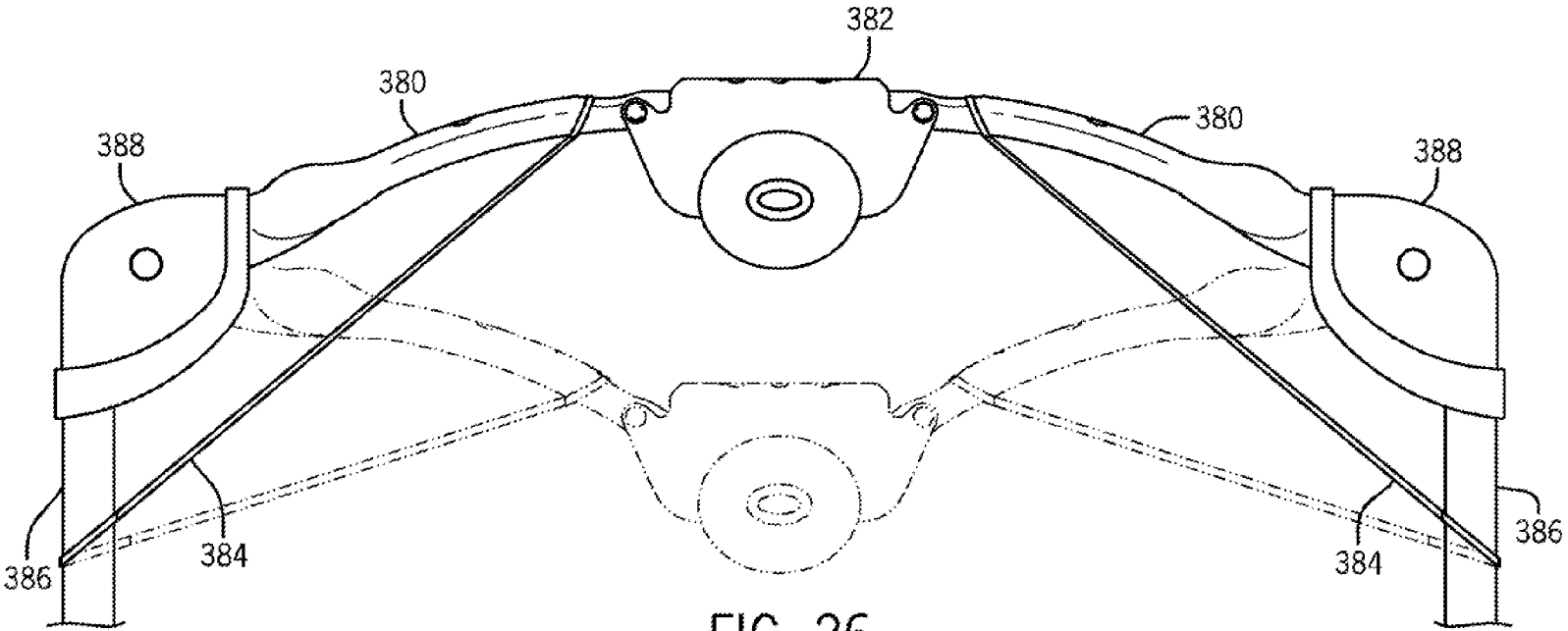
FIG. 26 is an elevational front view of still another alternative spring-biased top rail latch assembly in a latched state and with another rail section in a released state shown in phantom.

FIG. 26 illustrates still another solution according to the teachings of the disclosure that can be employed with a pair of top rail sections 380 and a latching mechanism 382. In this example, a pair of resilient bands or other elastic elements 384 are utilized. Each band 384 is connected to a respective one of the top rail sections 380 near the latching mechanism 382, and is also connected under tension to a corresponding corner leg or post 386 of the playard below a pivot joint 388 at which the rail section 380 meets the leg 386. The bands 384 may be hidden by soft goods (not shown) disposed along the side of the playard. The top rail sections 380 are shown in the latched condition, while the unlatched state is shown in phantom. Due to the biasing force applied by the band(s) 384, the top rail sections 380 are also significantly displaced from the position in the latched state when either side of the latch mechanism 382 is unlatched. In that case, only one of the top rail sections 380 is partly pulled down by the elastic band 384. As a result, the false latch condition is avoided through a clear indication to a user that one of the top rail sections 380 is not properly and completely latched.

Figure 27:
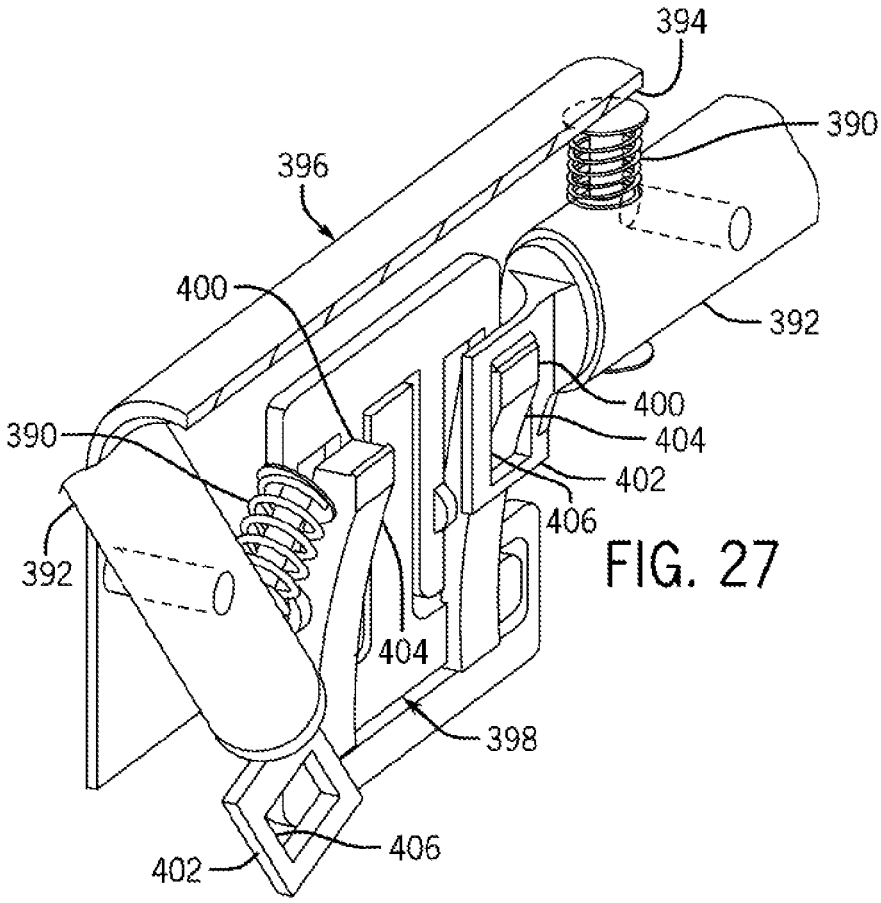
FIG. 27 is an elevational front view of still another alternative spring-biased top rail latch assembly with one rail section in a latched state and with another rail section in a released state shown in phantom.

FIG. 27 illustrates yet another possible example of a solution according to the teachings of the disclosure. In this example, two vertically oriented springs 390 are mounted on respective rail sections 392 to push against a housing surface 394. The force provided by the springs 390 biases a latch mechanism 396 down toward the folded condition. The push of an actuator 398 forces a pawl 400 out of a catch 402, thereby allowing the rail section 392 to fall. In order for the latch mechanism 396 to be fully latched, the catch 402 rides over a cam 404 to seat the pawl 400 in a slot 406. If the catch 402 does not ride over the cam 404, the latch mechanism 396 falls. To reach the latched condition, the user raises the latch mechanism 396 sufficiently to overcome the spring forces.

Figure 28:
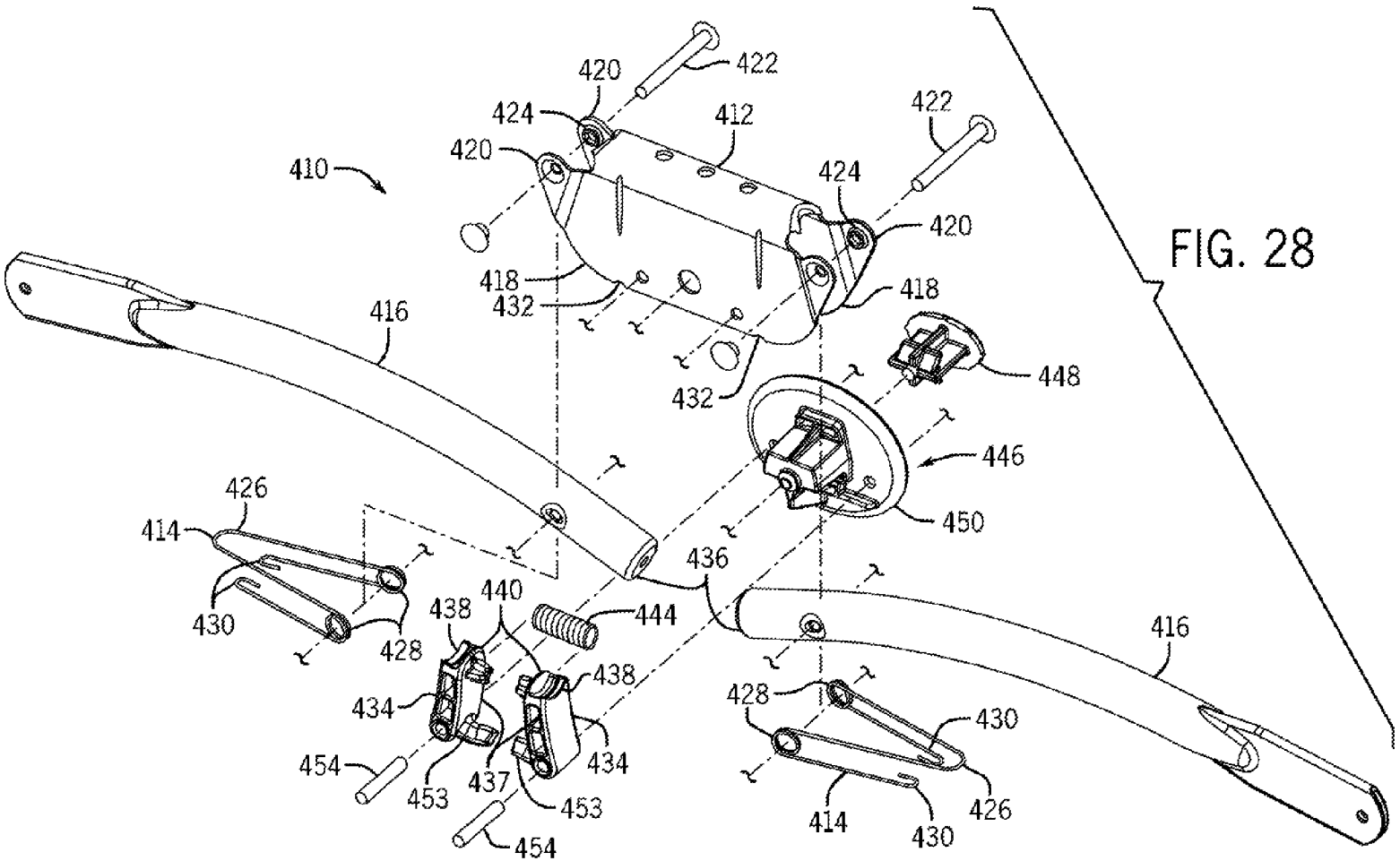
FIG. 28 is a perspective, exploded view of an exemplary spring-biased latch assembly for one of the top rails of FIG. 1 in accordance with yet another embodiment.

Turning now to FIG. 28, another example of a latch assembly 410 constructed in accordance with several aspects of the disclosure includes a housing 412 and a pair of torsion springs 414 to bias rail sections 416 away from the latched state. In this example, each torsion spring 414 is not disposed within the housing 412, but rather runs along the exterior surfaces of two spaced apart faceplates 418 of the housing 412. Each faceplate 418 may be arranged (e.g., front and rear) and constructed in a manner similar to those described above to form a shell or bracket that contains components of the latch assembly 410. In this case, the housing 412 does not include rail connectors, but instead links the rail sections 416 to the housing 412 via opposed pairs of pivot ears or tabs 420 on each lateral end or edge of the faceplates 418. Pivot pins or bolts 422 extend between the faceplates 418 and are captured in holes in each rail section 416 and pivot ear 420. Each rail section 416 can then move between in-use and folded orientations by pivoting about the pivot points defined by the ears 420 and the pins 422.

Each pivot ear 420 in this example is displaced from the plane of its faceplate 418 to accommodate the winding of the torsion spring 414 about the pivot pin 422. To this end, each pivot ear 420 on the front faceplate 418 is bent forward, and each pivot ear 420 on the rear faceplate 418 is bent rearward. Each pivot ear 420 also has a boss 424 that acts as a spring guide. Each boss 424 helps hold the winding of each torsion spring 414 in place during installation.

The configuration of the torsion springs 414 may vary from the example shown. Generally speaking, each torsion spring 414 includes a fixed section, a winding section, and a bias section, as described above. The lever section of each spring 414 is configured to engage one of the rail sections 416. To that end, each torsion spring 414 may be configured in a manner similar to the example described above, with the bias section having a bail or U-shaped lever 426 in which the rail section 416 is captured. The bail 426 of each torsion spring 414 extends laterally outward from the winding section, which includes a pair of windings 428 on either side of the rail section 416. From each winding 428 of the torsion spring 414, a hook 430 extends to engage the latch assembly 410. In this example, each hook 430 is attached to a respective one of the faceplates 418. To that end, a bottom edge of each faceplate 418 has a notch 432 engaged by the hook 430 as shown in FIG. 29.

The latch assembly 410 includes a pair of opposing, synchronized pawls 434 disposed within the housing 412 that define latches in which ends 436 of the rail sections 416 are captured. In this example, each pawl or latch 434 forms an L-shaped lever with an upper finger 437 having a top end shaped to form a latch seat 438. With the end 436 of each rail section 416 being generally tube-shaped, the latch seat 438 may be shaped as a saddle in which the rail section 416 rests. As best shown in FIG. 29, the latch seat 438 also includes a catch 440 engaged by the end 436 of the rail section 416 to maintain the position of the rail section 416 in the latched state. An inner face of the upper finger 437 of each pawl 434 also has a spring guide 442 to hold a helical return spring 444 between the pawls 434. The return spring 444 biases the top ends of the pawls 434 away from one another, thereby helping to maintain the latched state shown in FIG. 29, while establishing the force to be overcome for latch release.

To release the latch assembly 410 from the latched state, an actuator 446 includes a pushbutton 448 and a receiver 450 in which the pushbutton 448 is inwardly inserted in a manner similar to the examples described above. The receiver 450 is mounted on one of the faceplates 418 such that a frame 452 of the actuator 446 is positioned between the faceplates 418 and between the pawls 434. As described below, pushing the pushbutton 448 farther into the receiver 450 acts on a lower finger 453 of each pawl 434 to compress the spring 444 and disengage the rail sections 416 from the latch seats 438.

Figure 29:
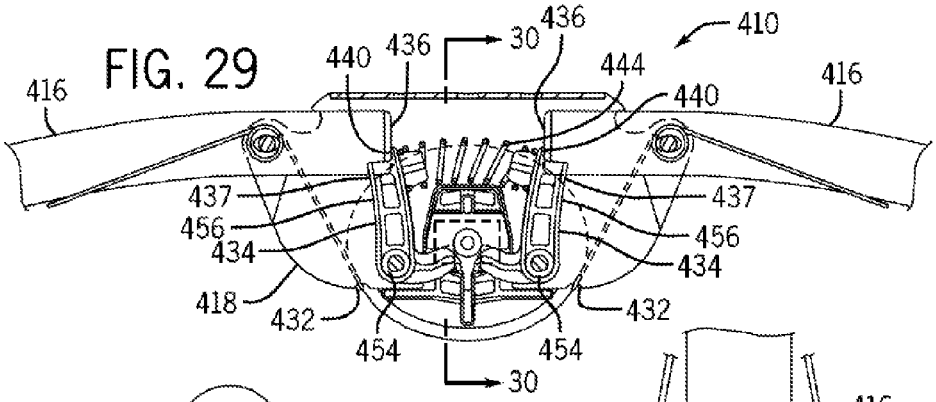
FIG. 29 is an elevational, cutaway view of the latch assembly of FIG. 28 to depict a pair of synchronized levers or pawls thereof in a latched state for an in-use or set-up orientation of the playard of FIG. 1.
Figure 30:
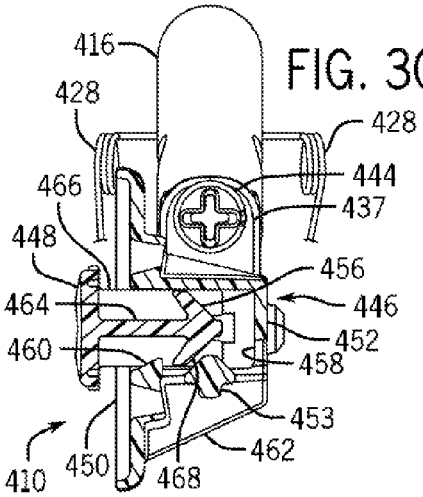
FIG. 30 is a sectional view of the latch assembly of FIG. 28 taken along lines 30-30 in FIG. 29 to depict an actuator and one of the synchronized levers or pawls of the latch assembly in the latched state.
Figure 31:
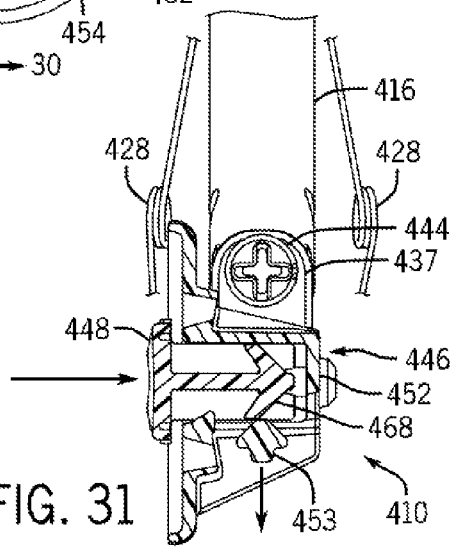
FIG. 31 is a sectional view of the latch assembly of FIG. 28 taken along lines 31-31 in FIG. 32 to depict the actuator and one of the synchronized levers or pawls of the latch assembly in a released or disengaged state.
Figure 32:
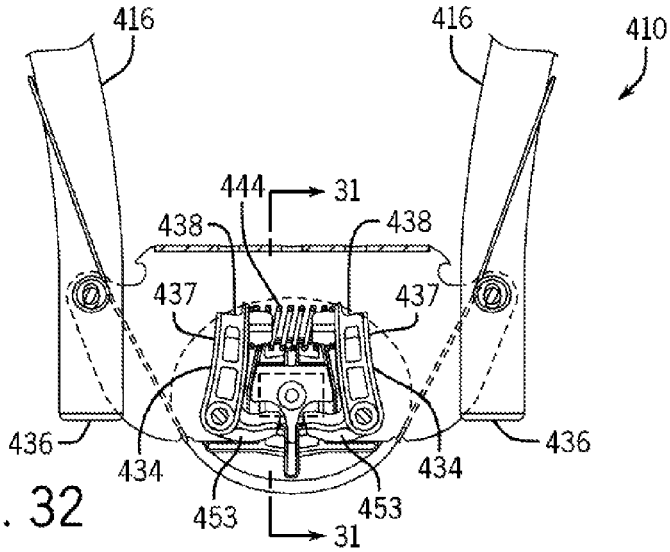
FIG. 32 is an elevational, cutaway view of the latch assembly of FIG. 28 in the released state to depict the operation of the actuator on the synchronized levers or pawls.

FIGS. 29-32 depict the latch assembly 410 in operation. FIGS. 29 and 30 show the latch assembly 410 in the latched state, while FIGS. 31 and 32 show the latched assembly 410 disengaged, and with the rail sections 416 in a folded orientation. Generally speaking, the opposing pawls 434 rotate within the housing 412 (FIG. 28) between the faceplates 418 to engage and disengage the latch assembly 410. In this example, the opposing pawls 434 reciprocate between an extended position best shown in FIG. 29 and a retracted position best shown in FIG. 32. The upper and lower fingers 437, 453 of each pawl 434 form a generally L-shaped lever best shown in FIGS. 29 and 32. In either the latched or unlatched positions, the upper finger 437 of the pawl 434 is generally upright or vertically oriented, while the lower finger 453 is generally horizontally oriented. The upper and lower fingers 437, 453 may be integrally formed. More generally, the fingers 437, 453 of each latch pawl 434 pivot about a respective mounting pin 454 (best shown in FIG. 28) between the extended and retracted positions. In the extended position, the helical spring 444 is expanded as shown in FIG. 29. As described below, pushing the actuator button 448 (FIG. 28) inward displaces both of the lower fingers 453, thereby drawing the upright finger 437 of each pawl 434 laterally inward, compressing the helical spring 444, as shown in FIG. 32.

The manner in which the actuator 446 moves the latch pawls 434 to release the exemplary latch assembly 410 is shown in the cross-sections of FIGS. 30 and 31. The faceplates 418 (FIG. 28) and other components of the housing 412 (FIG. 28) are not depicted in FIGS. 30 and 31 for ease in illustrating the operation of the actuator 446. In FIG. 30, the pushbutton 448 is shown prior to a user push. In that position, a bezel or ramped end 456 of the pushbutton 448 extends partially into a cavity 458 defined by the frame 452 of the actuator receiver 452. A stop 460 limits reverse travel of the pushbutton 448, and a upstanding support 462 of the frame 452 forms a track that guides the pushbutton 448 to prevent lateral movement. The pushbutton 448 has a body 464 with vertical and horizontal support ribs (best shown in FIG. 28) that run the length of the pushbutton. A vertical rib 466 may be configured to ride on or in the track 462 as a user pushes the pushbutton 448 and, thus, the body 464 thereof, farther into the cavity 458.

FIGS. 31 and 32 depict the movement of the pushbutton 448 and resulting disengagement of the latch assembly 410. A user has pushed the pushbutton 448 through the cavity 458 an extent such that the body 464 contacts a rear wall of the frame 452, the limit of travel for the pushbutton 448. As the pushbutton 448 travels, the bezel end 456 of the pushbutton 448 generally contacts both of the pawls 434 to disengage the latch assembly 410. To that end, the bezel end 456 includes a number of ramped surfaces on either side of the vertical rib 466. Lower ramped surfaces 468 are positioned within the cavity 458 to engage the lower fingers 453 of each pawl 434. In this example, the lower fingers 453 also have a ramped surface with a slope that cooperates with, or matches that of, the lower ramped surfaces 468 of the bezel end 456. Once the pushbutton 448 reaches its travel limit, the bezel end 456 has translated that horizontal motion into generally vertical, downward movement of the lower fingers 453 to the position shown in FIGS. 31 and 32. The downward movement of the lower fingers 453, in turn, causes each pawl 434 to rotate about the pivot pin 454, as best shown in FIG. 32. The rotation drives top ends of the upper fingers 437 inward, compressing the spring 444. Once the upper fingers 437 have rotated inward enough for the end 436 of the rail sections 416 to clear the latch seat 438 of each pawl 434, each rail section 416 is released and capable of movement toward the folded orientation shown in FIG. 32.

After the user discontinues pushing on the pushbutton 448, the bias force provided by the spring 444 returns each pawl 434, the pushbutton 448, and the rest of the latch assembly 410 to their respective resting, ready-to-latch states or positions. The upper finger 437 of each pawl 434 is pushed or rotated laterally outward by the spring 444, causing the lower fingers 453 to rise, thereby driving the bezel end 456 of the pushbutton 448 in the reverse direction. The pushbutton 448 and the pawls 434 thus return to the positions shown in FIG. 30. When the rail sections 416 are later rotated from the folded orientation (FIG. 32) back to the in-use orientation (FIG. 29), the end 436 of each rail section 416 may slide upward along a laterally outer surface of the fingers 437, rotating the upper fingers 437 inward, which compresses the spring 444. Once the ends 436 of the rail sections 416 clear the edge of the latch seat 438, the spring 444 decompresses, forcing the upper fingers 437 rotate laterally outward until the rail sections 416 are secured in the latched positions.

In the event that one (or both) of the rail sections 416 is rotated sufficiently to approach, but not engage, the latch seat 438, the bias force provided by the torsion spring(s) 414 drives the rail section 416 away from the latched state to prevent a false latch condition. To this end, each torsion spring 414 loops under and along one of the rail sections 416 to pull the rail section 416 upward from the position shown in FIG. 30. In this example, each torsion spring 414 is fixed to both sides of the latch housing 412, with one side of each torsion spring 414 running along the front faceplate 418, and the other side of the torsion spring 414 running along the rear faceplate 418. The path of each torsion spring 414 runs along exterior sides of the faceplates 418 in this example before reaching the winding 428 about the pivot pins 422. Because the ears 420 (FIG. 28) of the housing 412 are outwardly offset from the remainder of the faceplates 418, the windings 428 can be disposed within the housing 412, securely contained between the rail section 416 and the ears 420. In other cases, the arrangements of these sections of the torsion spring 414 may vary. For example, the torsion springs 414 may be configured to run along interior sides of the faceplates 418. The configuration of the bail or lever section 426 of each torsion spring 414 may also vary from the example shown, as the torsion spring 414 may engage the rail section 416 in a variety of ways.

The tension or force applied in each of the above-described examples inhibits a false latching condition by producing a readily visible clue to a user that the top rail is not completely latched. To this end, each of the disclosed examples utilizes a spring force or other suitable biasing force. In the above-described examples, a biasing element is coupled to the top rail either indirectly (FIGS. 2-21) or directly (FIGS. 23-32) and biases the top rail against the latching direction. The intent is to have the biasing element force the top rail to automatically move from a nearly latched or false latched position to a clearly visible unlatched position so a user will be aware that the top rail is not properly latched. If the top rail is latched, the latching mechanism will retain the top rail in the latched configuration despite the force applied by the biasing element or spring(s). The spring force should be applied in a direction that will bias the top rail toward the unlatched position and should be sufficient to overcome any geometry and soft goods forces applied to the top rail that might otherwise hold the unlatched top rail in a false latched orientation.

A number of alternatives and examples are provided herein for the false latch bias element or spring. Thus, the structure, type, location, and orientation of the bias element(s) or spring (s) may vary. In some of the examples, the spring or bias force is disposed within the latching mechanism. For instance, the spring may bias two linkage components of the latching mechanism apart and away from the latched state. As a result, the biasing element indirectly biases the top rail sections away from the in-use orientation. In other examples, the springs act on other surfaces of the latching device or the playard frame. In these and other cases, the springs, bands, straps, or other elastic or biasing elements may be coupled directly to the top rail sections to bias the top rail toward the unlatched orientation. These and other characteristics of the biasing elements may vary from the examples shown and described herein.

Although certain playards, playard top rails, and playard top rail latch assemblies have been described herein in accordance with the teachings of the present disclosure, the scope of coverage of this disclosure is not limited thereto. On the contrary, all embodiments of the teachings of the disclosure that fairly fall within the scope of permissible equivalents are disclosed by implication herein.

What is claimed is:

1. A juvenile product comprising:

a frame including a rail, the rail including first and second rail sections;

a latch assembly coupling the first and second rail sections and configured to reside in a latched state for an in-use orientation of the rail; and a pair of torsion springs disposed between the latch assembly and a respective one of the first rail section and the second rail section and configured to be under increasing tension as the latch assembly nears the latched state such that a bias force applied by the pair of torsion springs increasingly drives the rail away from the in-use orientation when the rail is near the in-use orientation with the latch assembly not in the latched state;

wherein each torsion spring includes a pair of windings disposed along opposing sides of the first or second rail section, and further includes a bail extending from the pair of windings in which the first or section rail section is captured.

2. The juvenile product of claim 1, wherein each torsion spring has a fixed section attached to the latch assembly and a bias section that includes the bail and applies the bias force to a respective one of the first and second rail sections.

3. The juvenile product of claim 1, wherein the latch assembly includes a pair of opposing pawls, each pawl having a latch seat configured to capture a respective one of the first and second rail sections in the in-use orientation.

4. A juvenile product comprising:

a frame including a rail, the rail including first and second rail sections;

a latch assembly coupling the first and second rail sections and configured to reside in a latched state for an in-use orientation of the rail; and an elastic bias element coupled to one or both of the first rail section and the second rail section and configured to be under increasing tension as the latch assembly nears the latched state such that a bias force applied by the elastic bias element increasingly drives the rail away from the in-use orientation when the rail is near the in-use orientation with the latch assembly not in the latched state;

wherein the latch assembly includes a pair of crosslinks, each crosslink coupling the first and second rail sections, and wherein the elastic bias element applies the bias force to the crosslinks in or near the in-use orientation.

5. The juvenile product of claim 4, wherein each crosslink includes an elongate strip with a contoured edge that defines a channel in which a latch pin of the latch assembly is captured in the latched state.

6. A juvenile product comprising:

a frame including a rail, the rail including first and second rail sections;

a latch assembly configured to reside in a latched state for an in-use orientation of the rail, the latch assembly including a housing and a pair of latch crosslinks disposed within the housing, each latch crosslink coupling the first and second rail sections; and a bias spring disposed within the housing, coupled to the first and second rail sections, and configured to be under tension near the in-use orientation such that the elastic bias element drives the rail away from the in-use orientation when the rail is near the in-use orientation with the latch assembly not in the latched state.

7. The juvenile product of claim 6, wherein the bias spring applies a bias force to the first and second latch crosslinks.

8. The juvenile product of claim 6, wherein the bias spring includes first and second torsion springs, each having a fixed section attached to the latch assembly and a bias section that applies a bias force to one of the first and second rail sections.

9. The juvenile product of claim 6, wherein each crosslink includes an elongate strip, and wherein the elongate strips are oriented in parallel planes.

10. The juvenile product of claim 6, wherein each crosslink includes an elongate strip with a contoured edge that defines a channel in which a latch pin of the latch assembly is captured in the latched state.

11. A juvenile product comprising:

a frame including a rail, the rail including first and second rail sections;

a latch assembly coupling the first and second rail sections and configured to reside in a latched state for an in-use orientation of the rail; and first and second torsion springs coupled to the first and second rail sections, respectively, and configured to be under tension in or near the in-use orientation such that the first and second torsion springs drive the rail away from the in-use orientation when the rail is near the in-use orientation with the latch assembly not in the latched state.

12. The juvenile product of claim 11, wherein the latch assembly includes a housing, and wherein each of the first and second torsion springs includes a pair of hooks attached to the housing.

13. The juvenile product of claim 11, wherein the latch assembly includes a housing, the housing including a pair of spaced apart faceplates, each faceplate having a pair of ear tabs to guide windings of the first and second torsion springs and receive pivot pins about which the first and second rail sections pivot.

14. The juvenile product of claim 11, wherein the latch assembly includes a housing and a pair of pawls disposed within the housing, each pawl including a latch seat configured to capture a respective one of the first and second rail sections in the in-use orientation.

15. The juvenile product of claim 11, wherein each of the first and second torsion springs includes a bail that engages and applies force to a respective one of the first and second rail sections.

16. The juvenile product of claim 11, wherein the latch assembly includes a housing, the housing including a pair of spaced apart faceplates, and wherein each of the first and second torsion springs runs along an exterior surface of each faceplate of the housing.

17. The juvenile product of claim 1, wherein the latch assembly includes a pair of pawls configured to capture the first and second rail sections and further includes a pushbutton that contacts the pair of pawls via a ramped surface to disengage the latch assembly from the latched state.

18. The juvenile product of claim 17, wherein each pawl is configured as an L-shaped lever, the L-shaped lever including a first finger configured as a latch seat to capture respective ends of the first and second rail sections, and further including a second finger on which the pushbutton acts to disengage the latch assembly from the latched state.

19. The juvenile product of claim 18, wherein the second finger includes the ramped surface.

20. The juvenile product of claim 18, wherein the pushbutton includes a ramped end and the second finger includes the ramped surface, the ramped surface being configured to cooperate with the ramped end of the pushbutton.

* * * * *